US009700776B2

(12) United States Patent
Shocklee et al.

(10) Patent No.: US 9,700,776 B2
(45) **Date of Patent: *Jul. 11, 2017**

(54) HANDLE WEIGHTED BAT AND ASSEMBLY PROCESS

(71) Applicant: 5 STAR, LLC, Gaithersburg, MD (US)

(72) Inventors: Christopher Shocklee, Elkridge, MD (US); Donald L. Mackey, West Friendship, MD (US)

(73) Assignee: 5 Star, LLC, Gaithersburg, MD (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/680,015

(22) Filed: Apr. 6, 2015

(65) Prior Publication Data

US 2015/0209640 A1 Jul. 30, 2015

Related U.S. Application Data

(63) Continuation of application No. 14/481,856, filed on Sep. 9, 2014, now Pat. No. 8,998,754, which is a (Continued)

(51) Int. Cl.
*A63B 59/06* (2006.01)
*A63B 69/00* (2006.01)
(Continued)

(52) U.S. Cl.
CPC ..... *A63B 69/0002* (2013.01); *A63B 15/00* (2013.01); *A63B 24/0003* (2013.01); *A63B 59/50* (2015.10); *A63B 60/04* (2015.10); *A63B 60/06* (2015.10); *A63B 60/08* (2015.10); *A63B 60/10* (2015.10); *A63B 60/42* (2015.10); *A63B 2069/0008* (2013.01); *A63B 2069/3605* (2013.01); *A63B 2071/0694* (2013.01); *A63B 2102/18* (2015.10); *A63B 2209/00* (2013.01); *A63B 2209/10* (2013.01); *A63B 2220/806* (2013.01); *A63B 2220/833* (2013.01); *A63B 2220/836* (2013.01); *A63B 2225/20* (2013.01); *A63B 2225/50* (2013.01)

(58) Field of Classification Search
CPC ..... A63B 2102/18; A63B 2102/182; A63B 59/50–59/58; A63B 59/581; A63B 60/02; A63B 60/06; A63B 60/08; A63B 60/16; A63B 60/24; A63B 2069/0008
USPC ..... 473/457, 519, 520, 564–568
See application file for complete search history.

(56) References Cited

U.S. PATENT DOCUMENTS 364,160 A 5/1887 Cundey
377,686 A 2/1888 Moose
(Continued)

OTHER PUBLICATIONS

Terry Bahill and Miguel Morna Freitas, Complex Motor Behaviors—Two Methods for Recommending Bat Weights, Annals of Biomedical Engineering, 1995, pp. 436-444, vol. 23, USA.

*Primary Examiner* — Mark Graham
(74) *Attorney, Agent, or Firm* — Doster Greene, LLC

(57) ABSTRACT

A handle weighted bat according to various embodiments can include an elongated barrel portion. A handle weighted portion is included such that the largest concentration of mass is provided in the handle portion and for positioning the center of gravity within the handle portion of the bat. The handle weighted portion is configured as a one-piece, solid body construction that forms an integral knob and rod portion.

10 Claims, 15 Drawing Sheets

Related U.S. Application Data continuation of application No. 13/364,312, filed on Feb. 1, 2012, now Pat. No. 8,827,846.

(51) Int. Cl.

| | |
|---|---|
| ***A63B 15/00*** | (2006.01) |
| ***A63B 24/00*** | (2006.01) |
| ***A63B 60/10*** | (2015.01) |
| ***A63B 60/06*** | (2015.01) |
| ***A63B 60/08*** | (2015.01) |
| ***A63B 60/42*** | (2015.01) |
| ***A63B 59/50*** | (2015.01) |
| ***A63B 60/04*** | (2015.01) |
| *A63B 69/36* | (2006.01) |
| *A63B 71/06* | (2006.01) |
| *A63B 102/18* | (2015.01) |

(56) References Cited

U.S. PATENT DOCUMENTS 514,420 A 2/1894 Jacobus
796,184 A 8/1905 Brown
814,857 A 3/1906 Maechling
1,026,990 A * 5/1912 Matson ..... A63B 60/02 473/49
1,212,038 A * 1/1917 Flaxman ..... A63D 15/08 473/203
1,603,904 A * 10/1926 Cohn ..... A63B 59/50 473/519
1,611,858 A 12/1926 Middlekauff
1,665,195 A 4/1928 Cohn
2,121,289 A 6/1938 Gleadall
2,195,681 A 4/1940 Robarge
2,379,006 A 6/1945 Johnson
3,479,030 A 11/1969 Merola
3,877,698 A 4/1975 Volpe
3,927,466 A * 12/1975 Rosalsky ..... B23P 11/005 29/511
3,955,816 A 5/1976 Bratt
3,972,528 A 8/1976 McCracken et al.
4,000,895 A * 1/1977 Scott, Jr. ..... A63B 59/50 473/566
4,213,607 A * 7/1980 Fujii ..... A63B 60/08 29/505
4,274,631 A 6/1981 Hayazaki
4,323,239 A 4/1982 Ishii
4,452,456 A 6/1984 Kochevar
4,505,479 A 3/1985 Souders
4,600,190 A 7/1986 Berokoff
4,634,121 A * 1/1987 Sasaki ..... A63B 15/00 473/457
4,671,508 A 6/1987 Tetreault
4,682,773 A 7/1987 Pomilia
4,763,899 A 8/1988 Hundley
4,768,785 A * 9/1988 Patterson ..... A63B 60/10 473/457
4,834,370 A 5/1989 Noble et al.
4,898,386 A 2/1990 Anderson
4,936,586 A * 6/1990 Van Raemdonck ... A63B 49/08 473/297
4,940,247 A 7/1990 Magadini
5,094,453 A 3/1992 Douglas et al.
5,118,102 A 6/1992 Bahill et al.
5,303,917 A 4/1994 Uke
5,393,055 A 2/1995 MacKay, Jr.
5,409,214 A 4/1995 Cook
5,458,330 A 10/1995 Baum
5,501,450 A 3/1996 Nolan
5,577,966 A 11/1996 Duran
5,672,809 A 9/1997 Brandt
5,674,138 A * 10/1997 Nolan ..... A63B 15/00 473/457
5,741,193 A 4/1998 Nolan
5,772,541 A * 6/1998 Buiatti ..... F41B 5/1426 124/23.1
5,799,937 A 9/1998 Nolan
5,899,823 A 5/1999 Eggiman
6,042,492 A 3/2000 Baum
6,254,502 B1 7/2001 Becker
6,280,353 B1 8/2001 Brundage
D457,929 S 5/2002 Ciesar et al.
6,406,387 B1 6/2002 Ryan
6,432,006 B1 * 8/2002 Tribble ..... A63B 60/10 473/564
6,511,386 B1 1/2003 Cacicedo
6,530,852 B2 3/2003 Rios
6,561,930 B2 5/2003 Mabry
6,575,854 B1 6/2003 Yang et al.
6,682,447 B1 * 1/2004 Black ..... A63B 15/00 473/457
6,692,386 B2 2/2004 Brundage
6,702,698 B2 3/2004 Eggiman et al.
6,743,127 B2 6/2004 Eggiman et al.
6,767,299 B1 7/2004 Chang
6,783,471 B2 8/2004 Bolduc et al.
6,918,843 B1 7/2005 Franssen
6,949,036 B2 9/2005 Ciesar et al.
6,955,610 B1 10/2005 Czaja et al.
6,991,551 B2 1/2006 Tolentino et al.
7,044,858 B1 5/2006 Otto et al.
7,052,419 B2 5/2006 Chang
7,056,240 B2 6/2006 Brock et al.
7,140,988 B1 11/2006 Hinman
7,150,400 B2 12/2006 Melick et al.
7,198,581 B1 4/2007 Black
7,201,683 B2 * 4/2007 Estape ..... A63B 60/10 473/568
7,261,654 B2 8/2007 Cheng
7,297,077 B1 11/2007 Battaglino
7,410,433 B2 8/2008 Guenther et al.
7,736,242 B2 6/2010 Stites et al.
7,766,756 B2 8/2010 Mabe et al.
7,794,340 B2 9/2010 Mauer et al.
7,798,926 B1 9/2010 Hsu
7,837,572 B2 11/2010 Bissonnette et al.
7,878,930 B2 2/2011 Leinert
D702,302 S 4/2014 Rockhill
8,845,462 B2 * 9/2014 Chung ..... A63B 59/50 422/422
8,864,608 B2 10/2014 Rockhill
8,998,754 B2 * 4/2015 Shocklee ..... A63B 69/0002 473/519
2002/0064764 A1 5/2002 Fishman et al.
2003/0069095 A1 4/2003 Turos
2003/0114257 A1 6/2003 Mabry
2003/0144089 A1 7/2003 Ryan
2004/0048696 A1 3/2004 Ciesar et al.
2005/0037847 A1 2/2005 Pickens, Jr.
2005/0153800 A1 * 7/2005 Tolentino ..... A63B 59/50 473/564
2005/0202893 A1 9/2005 Otten et al.
2006/0022796 A1 2/2006 Striemer
2006/0025246 A1 2/2006 Forney et al.
2006/0183546 A1 8/2006 Addington et al.
2006/0211510 A1 9/2006 Ashida et al.
2008/0161140 A1 7/2008 Misono et al.
2008/0220867 A1 9/2008 Zalewski et al.
2010/0210371 A1 8/2010 Sato et al.
2011/0118621 A1 5/2011 Chu
2011/0143870 A1 6/2011 Schulte
2011/0251021 A1 10/2011 Zavadsky et al.
2012/0108354 A1 5/2012 Kamino et al.
2012/0122574 A1 5/2012 Fitzpatrick et al.
2012/0214622 A1 * 8/2012 Rockhill ..... A63B 69/3638 473/457
2014/0342854 A1 * 11/2014 Thurman ..... G06Q 30/0621 473/519
2015/0157909 A1 * 6/2015 Van Nguyen ..... A63B 59/0092 473/568

* cited by examiner

HANDLE WEIGHTED BAT AND ASSEMBLY PROCESS

RELATED APPLICATIONS

This application is a continuation of U.S. application Ser. No. 14/481,856, filed Sep. 9, 2014, which is a continuation-in-part of U.S. application Ser. No. 13/364,312 filed Feb. 1, 2012, and now U.S. Pat. No. 8,827,846.

FIELD

The present teachings relate to devices and systems for a handle weighted bat.

INTRODUCTION

In baseball today the most prominent theory for efficiently hitting a baseball is the application of rotational dynamics. Rotational dynamics comprises two key batting components namely circular hand path (CHP) and torque. FIG. 7 shows a top view diagram of a batter's circular hand path in the batter's box where rotational dynamics are employed to hit the ball. CHP is the transfer of the body's rotational momentum that occurs when the hands are taken in a circular path, as when swinging a bat. Torque is the force that is applied at the bat handle by the push and pull of the hands, arms and shoulders in opposite directions. The acceleration of the bat head generated from the CHP is referred to as the "Pendulum Effect." A big part of a hitter's bat speed is generated from the circular path of his hands (similar to swinging a ball connected to the end of a string). As long as the hitter keeps their hands in a circular path, the ball will continue to accelerate in a circle. But if the path of the hand follows a linear path, the ball on the end of the string loses angular velocity. FIG. 6 shows a top view diagram of a batter's hand path in the batter's box where linear batting dynamics are employed to hit the ball.

The same rationale applies when a hitter is swinging a bat. If the hands are kept in a circular path as shown in FIG. 7, the bat will continue to accelerate. But if the path of the hands follow a linear or near linear path as shown in FIG. 6, then the batter loses the circular path and the bat will loses speed. FIG. 6 shows a top view diagram of a batter's hand path in the batter's box where linear batting dynamics are employed to hit the ball. A batter using this linear hand path tries to compensate for this loss of bat speed by making an essential strong wrist release near the hitting zone over the plate. Note how much more linear motion the hands exhibit as the bat enters the hitting zone near home plate. The straightening of the hands during a batter's swing occurs in most situations where a linear component is introduced into the swing path by the batter. In years past, the linear swing had been taught as the proper way to swing by many swing coaches. Even today many little leaguers, high school, semi pro and professional players are using linear dynamics in their swings. It has been found however that linear swing dynamics do not "scale up" effectively. Many young players may find success in the lower ranks of baseball using this method however they seem to hit a brick wall when they move up to the upper echelons of professional baseball where they find great difficulty hitting the 90+ MPH speed pitches. The success of the few professional players who continue to use linear dynamics in their swing is likely a result of their extraordinary athletic ability rather than the soundness of their hitting mechanics.

While rotational dynamics are considered to be the best approach to hitting effectively, many of the training and warm up batting aids do not reinforce rotational dynamics and a circular hand path in the batter's swing. A hitter warming up using weighted sleeves and donuts is in actuality, degrading the hitter's swing. The weight distribution of donuts and sleeves at the end of the bat negatively affects the hitter's natural swing, pulling their hands away from the body and distorting their CHP. As a result, swinging with donuts and end-loaded bats forces the hitter into a more linear swing. This limits the amount of torque that they can generate, and as a result, slows their bat speed and ultimately reduces their power.

SUMMARY

The present invention may satisfy one or more of the above-mentioned desirable features. Other features and/or advantages may become apparent from the description which follows.

It is an object of the present teaching to provide a device, more heavily weighted at the handle, for any sports making use of a club, racket, bat, stick or similar device where swinging the device is an integral part of the game or activity. It is an object of this invention to provide a batting training aid that is weighted on one end to promote and reinforce a batter's circular hand path (CHP) during the execution of their swing.

It is another object of this invention to provide a bat that is weighted in the knob and the handles such that the center of gravity of the bat is located in the lower section of the bat to promote and reinforce a circular hand path (CHP) during the execution of the swing.

It is another object of this invention to provide a modular arrangement of the training aids and bats such that the knobs, the handles and bat contact portions are interchangeable.

It is another object of this invention to provide a testing and custom fitting system where a hitters swing dynamics can be measured and observed to fit the hitter with the training aids or bat configurations that would best promote and reinforce a circular hand path (CHP) during the execution of their swing.

In the following description, certain aspects and embodiments will become evident. It should be understood that the invention, in its broadest sense, could be practiced without having one or more features of these aspects and embodiments. It should be understood that these aspects and embodiments are merely exemplary and explanatory and are not restrictive of the invention.

BRIEF DESCRIPTION OF THE DRAWINGS

The skilled artisan will understand that the drawings described below are for illustrative purposes only. The drawings are not intended to limit the scope of the present teachings in any way.

DETAILED DESCRIPTION OF VARIOUS EMBODIMENTS

Reference will now be made to various embodiments, examples of which are illustrated in the accompanying drawings. However, these various exemplary embodiments are not intended to limit the disclosure. On the contrary, the disclosure is intended to cover alternatives, modifications, and equivalents.

Throughout the application, description of various embodiments may use "comprising" language, however, it will be understood by one of skill in the art, that in some specific instances, an embodiment can alternatively be described using the language "consisting essentially of" or "consisting of."

For purposes of better understanding the present teachings and in no way limiting the scope of the teachings, it will be clear to one of skill in the art that the use of the singular includes the plural unless specifically stated otherwise. Therefore, the terms "a," "an" and "at least one" are used interchangeably in this application. Unless otherwise indicated, all numbers expressing quantities, percentages or proportions, and other numerical values used in the specification and claims, are to be understood as being modified in all instances by the term "about."

Various embodiments described herein provide a batting training aid that is weighted on one end to promote and reinforce a batter's circular hand path (CHP) during the execution of their swing. Various embodiments provide a bat that is weighted in the knob and the handles such that the center of gravity of the bat is located in the lower section of the bat to promote and reinforce a circular hand path (CHP) during the execution of the swing.

Various embodiments provide a modular arrangement of the training aids and bats such that the knobs, the handles and bat contact portions are interchangeable.

In various embodiments, the weighted handle device can be employed to train and enhance performance in sports and activities beyond baseball. The device can be employed in any sport making use of a club, racket, bat, stick or any similar hand held device, wherein swinging the device is an integral part of the game or activity. Softball, golf, tennis, cricket, badminton, hockey, lacrosse, field hockey, racket ball, squash, jai alai, etc. are examples of sports which can make use of the devices described herein. Beyond sports, the devices can be applied to a host of occupational medical/rehabilitation and general fitness application.

Various embodiments provide a testing and custom fitting system where a hitters swing dynamics can be measured and observed to fit the hitter with the training aids or bat configurations that would best promote and reinforce a circular hand path (CHP) during the execution of their swing.

Figure 1:
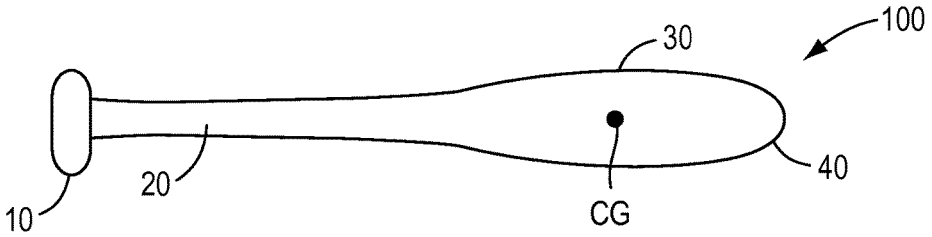
FIG. 1 (PRIOR ART)
FIG. 1 shows a typical baseball bat and the designated parts that form the bat structure.

FIG. 1 shows a diagram of the basic elements of a typical baseball bat 100. The knob 10 is located at a first end of the bat to prevent the batters hands from sliding off the bat during a hard swing. Adjacent the knob is the bat handle 20 where the batter grips and holds the bat while executing a swing. The barrel 30 is adjacent the handle and it is the surface that strikes the ball. End cap 40 defines the second end of the bat. The center of gravity CG of the bat is located in the barrel element since it has the largest concentration of mass.

Figure 2:
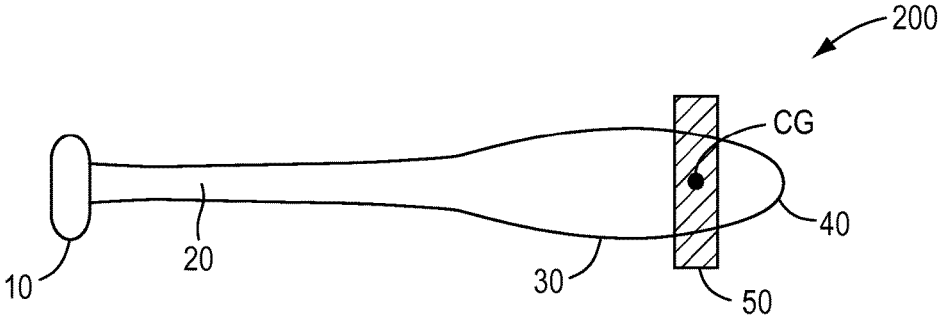
FIG. 2 (PRIOR ART)
FIG. 2 shows a typical baseball bat where a weighted donut is attached to the bat barrel for batter warm up and practice swings.
Figure 7:
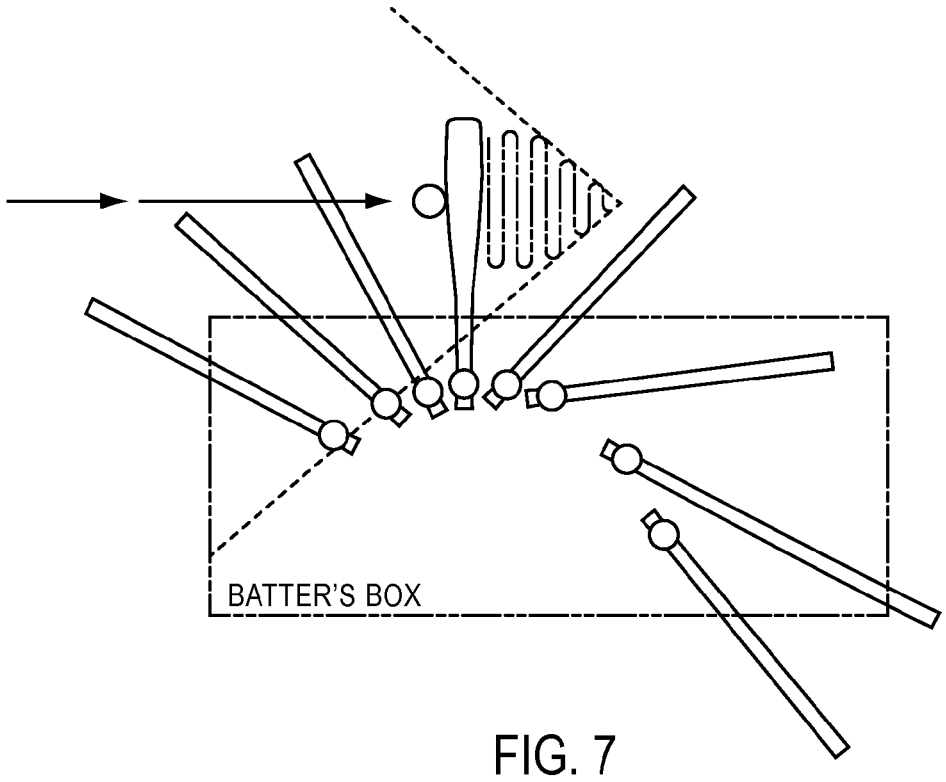
FIG. 7 shows a top view diagram of a batter's circular hand path in the batter's box where rotational dynamics are employed to hit the ball.

In FIG. 2, a typical weighted bat 200 is shown where a weighted donut 50 is attached to the barrel section 30. With the added weighted donut 50 the center of gravity of the weighted bat is now closer to the end cap 40 when compared to the typical bat 100 shown in FIG. 1. This positioning of the center of gravity CG near the end cap tends to pull the bat away from the body of the hitter during the swing. This particular motion is contrary to the desired motion of the circular hand path as shown in FIG. 7 which is considered to be the most efficient swing for hitting a baseball.

The handle weighted devices according to the present invention can be configured having various configurations depending upon the user's specific application. In some embodiments, the handle weighted device is configured having a barrel similar in size, shape, and proportion to conventional bats. The devices can be designed and manufactured according to conventional bat or training bat methods. In various embodiments, the handle weighted device can be configured having a walled shell with a completely hollow core or at least one hollow interior section of the core. In other embodiments, the handle weighted device can be configured having a solid core formed from a solid piece of material or filled, such as with foam or an insert, such as a metal, plastic or composite material.

In some embodiments, the handle weighted device can be made of a single material, such as aluminum, plastic, wood, and the like. The bat can be made, for example, of an all metal, such as aluminum, construction design or an all wood bat. In some embodiments, the handle weighted device can be made of more than one type of material such as, aluminum, plastic, wood, or a composite material. For example, the handle weighted device can be made of a hybrid construction wherein a portion of the device consists of one material and another portion consists of a different material. The device can be designed as a hybrid bat comprising a half metal and half wood composition. In some embodiments, the handle weighted device can be designed based upon the needs of a specific player. The weighted handle device can also be designed according to specific regulations of a governing sports body regarding equipment design for professional players, amateur players, collegiate players, or Little League players.

The wall or walls of the handle weighted device may be made of various known materials. In some embodiments, the wall or walls may be made of a single material, or a combination of materials. In some embodiments, the wall or wall may be made of a single layer material or multiple layers of materials. In some embodiments, the wall or walls may be configured having a uniform wall thickness. In other embodiments, the wall or walls may be configured with varying wall thickness.

The handle weighted device can be manufactured as a single-piece design or it may comprise plural pieces. During the manufacturing process, a single-piece design can be constructed, for example, with varying wall thickness formed within different sections of the device. In this example, the heaviest portion of the device can be configured as the handle having a thicker, denser shaft construction than the middle and end portion formed having a thinner, lighter construction. In other embodiments, the handle weighted device can be manufactured comprising two or more pieces. In a multiple-piece design example, a heavy handle construction can be initially fabricated and then attached to the device. For example, to provide an added weight in the handle, a heavy alloy such as steel may be included within the handle to form the heavy handle construction which can then be attached, by one or more various methods, to an aluminum-constructed mid and end section. Those having skills in the art would understand that other metals and alloys, such as varying grades of steel, iron, magnesium, titanium, copper, and graphite, can be used in the heavy handle construction. In lieu of or in addition to the metal or alloy, other weighting material, such as sand, ball bearings, water, stones or other viscous material, may be inserted into the heavy handle as additional filler or as the weighting component.

In comparison to a traditional bat, which typically weighs no more than 33 ounces, the handle weighted devices according to the present teachings can be configured such that a substantial weight is added in the handle, which causes the total weight of the bat to be approximately 40, 50, 60, 70, or 80 ounces. The largest concentration of mass is located in the handle. The devices can also range in length from 28 to 34 inches. Thus, the devices can be manufactured having several different weight options from which the user can test and select the appropriate batting configuration that is the best for the user. The weighted bat can be manufactured having, for example, five different weight options 40, 50, 60, 70, or 80 ounces at various lengths. The following tables demonstrate exemplary length and weight combinations for the training bat and the weighted bat.

Training Bat

| Length | Weight |
|---|---|
| 32 | 40 |
| 32 | 50 |
| 34 | 60 |
| 36 | 60 |
| 36 | 70 |
| 36 | 80 |

Weighted Bat

| Length | Weight |
|---|---|
| 28 | 40 |
| 30 | 40 |
| 30 | 50 |
| 32 | 60 |
| 33 | 60 |
| 34 | 70 |
| 34 | 80 |

The weighted devices in accordance with the present teachings may be configured having a variety of differing configurations, weights and weight attachment mechanisms. For example, a steel weight, due to its density of approximately 7,850 kg/m$^3$, can be included to add a substantial weight in the bat handle in some embodiments. However, in other embodiments, aluminum having a density of approximately 2,712 kg/m$^3$ or another material may be included rather than steel. In such embodiments, the substitution of aluminum being less dense than steel may require a larger weight with a different shape depending upon the desired weight.

Other sections of the weighted device, such as the end cap and the knob, may also be configured to accommodate specific design points. In some embodiments, the end cap may be removable to provide access to the internal core of the device and then securely reattached. The end cap may be made of any material capable of being associated with the barrel of the handle weighted device, such as metals, plastics, composite materials, or the like. In other embodiments, the end cap may be manufactured as an integral part of the device.

In lieu of or in addition to the weighted handle, the knob may be made of a weighting material. Such knobs can be made of various metal or alloy constructions and may be solid or hollow with varying wall thickness. In other embodiments, the knob can be constructed of a hollow or lighter material and the weighting material included only in the knob. In some embodiments, the knob can be configured similar to a traditional baseball bat knob. In other embodiments, the knob can be designed having decorative features of various sizes and shapes, such as a flare, ball, or disk design, that allow the user to comfortably grip the handle and swing the handle weighted device.

The attachment of the weighted handle to the knob will be configured to securely stabilize the weight and maintain the integrity of the device, because the heaviest portion of the device will be located in the handle. The handle weighted device in accordance with the present teachings may use a variety of differing configurations so as to securely attach the weighted handle to the knob. For example, in some embodiments, the handle and knob can be manufactured as a single, integral component. In other embodiments, the handle and the knob can be manufactured as separate components fastened by an attachment mechanism, for example, by a pin-connection, a screw connection, a ratchet screw connection, or any adhesive means. The attachment mechanisms can be further secured in the handle by using an adhesive or sealant. These attachment configurations are exemplary and non-limiting. When using the separate handle and knob embodiment, to assemble the components before use, the end cap may be removed, in some embodiments, to provide access to the hollow internal core. The heavy weighted material or weighted insert can be inserted inside the core and securely fastened to the handle by way of an attachment mechanism. The end cap is then replaced. In other embodiments, the weight can be inserted into the hollow core through the handle end and surrounded by additional filler material, if needed. In both embodiments, the user can select the amount of additional weight to be inserted into the device.

Figure 3A:
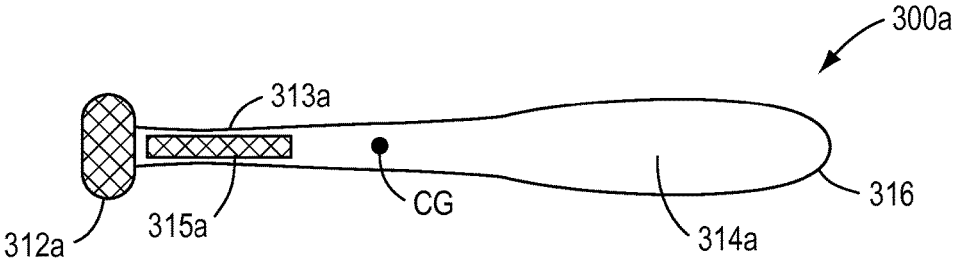
FIG. 3A shows a bat including a weighted knob and handle in accordance with the present teachings.

FIG. 3A shows a handle weighted bat 300*a* having a removable and replaceable weighted knob element 312*a*, a handle element 313*a* that houses a weight 315*a* and a barrel element 314*a* terminating in an end cap 316*a*. In this example, the CG is located at the end of the handle element 313*a* which greatly enhances the batters ability to follow the desired circular hand path of FIG. 7. With both the concentration of weight 315*a* in the handle 313*a* and the weighted knob 312*a* at one end of the bat, this introduces resistance to wrist release which acts to inhibit an essential element of the linear hitting dynamics and enhances the circular hand path. In this embodiment, the handle weighted bat 300*a* can be constructed of aluminum or steel and the knob 312*a* can be constructed as described above. The weighted knobs can be constructed in a variety of materials and construction. The knobs can be constructed of steel, aluminum and a variety of other metals or alloys. It is also contemplated that the knob elements can be constructed in a hollow configuration where materials like sand, ball bearings, water, stone or other viscous materials can be placed in the knobs. This configuration of the knob element may apply to all of the knob components of the handle weighted bats in accordance with the present teaching. The weighing element in FIG. 3A is shown having a relatively short length that does not extend into a tapering portion of the barrel of the bat 300*a*. Thus, to provide the substantial weight required in the handle when such shorter weights are selected, the weighting element is selected from one or more high density metal or alloy such as steel.

Figure 3B:
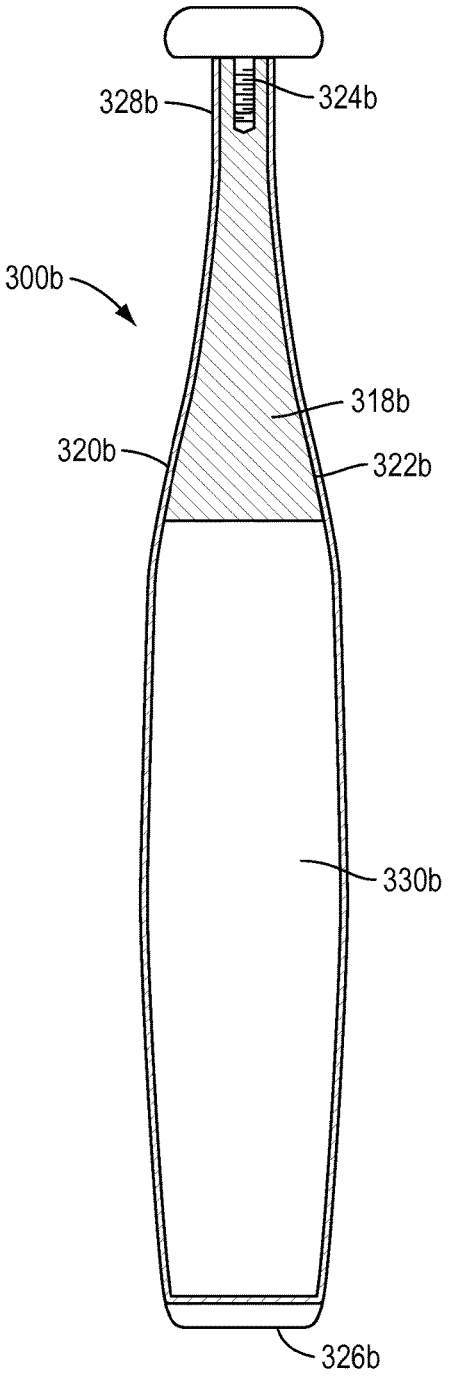
FIG. 3B shows an alternative embodiment of a bat including a weighted knob and handle in accordance with the present teachings.

In comparison to FIG. 3A, the exemplary embodiment of FIG. 3B illustrates the selection of a weighting element 318*b*, consisting of aluminum which is less dense than steel, but configured having substantially the same weight as steel in FIG. 3A inserted within a handle weighted bat 300*b*. When using a less dense material such as aluminum in comparison to steel, in order to obtain the desired substantial weight in the handle, the weighting element may be selected from a metal or alloy having measurements and configurations different from a more dense material. In comparison to FIG. 3A, the weighting element 318*b* is configured as a longer weight that extends into the tapered barrel section 320*b* and having a fluted end portion 322*b* that slightly flares outward corresponding to the configuration of the tapered barrel section 320*b*. Thus, the length and the shape of the aluminum weighting elements, in this embodiment, may be selected depending upon the additional weight desired to be added.

The attachment of the weighted handle to the knob will be configured to securely stabilize the substantial weight and maintain the integrity of the device, because the heaviest portion of the device will be located in the handle. In the exemplary embodiment of FIG. 3B, a screw connection 324*b* is provided as a weight attachment mechanism in the handle weighted bat 300*b*. For example, to assemble weighting element 318*b* into bat 300*b* for use, end cap 326*b* is removed, and the weighting element 318*b* is inserted into the hollow core 330*b* of the bat and attached within the handle 328*b* using the screw connection 324*b*. End cap 326*b* is securely reattached to close the end of the bat.

Figure 3C:
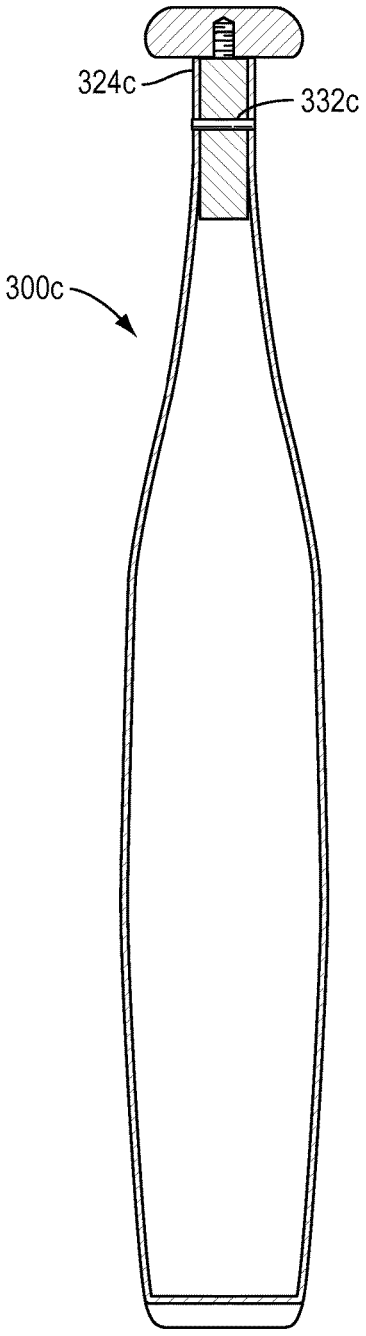
FIG. 3C shows yet another alternative embodiment of a bat including a weighted knob and handle in accordance with the present teachings.

In FIG. 3C, a ratchet screw-pin connection 324*c* is provided as an example of another weight attachment mechanism included in the handle weighted bat 300*c*. The screw ratchet assembly 324*c* is provided for mating and screwing the weight into the handle. The ratchet assembly 332*c* further includes a pin lock 332*c* that functions as a lock and a release button. During attachment of the weight, the pin 332*c* can be engaged to assisting with locking the weight into position relative to the handle and to prevent rotational movement of the weight. To remove the weight from the handle, the pin can be disengaged to release the weight and the weight can be unscrewed and removed from the handle. The ratchet screw-pin connection illustrates a locking pin system comprising a single pin. However, it would be understood that the use of other configurations, such as a two-pin or three-pin locking systems, are within the scope of the present teachings. Further, the attachment mechanisms depicted in FIGS. 3B and 3C are exemplary and non-limiting.

Figure 4A:
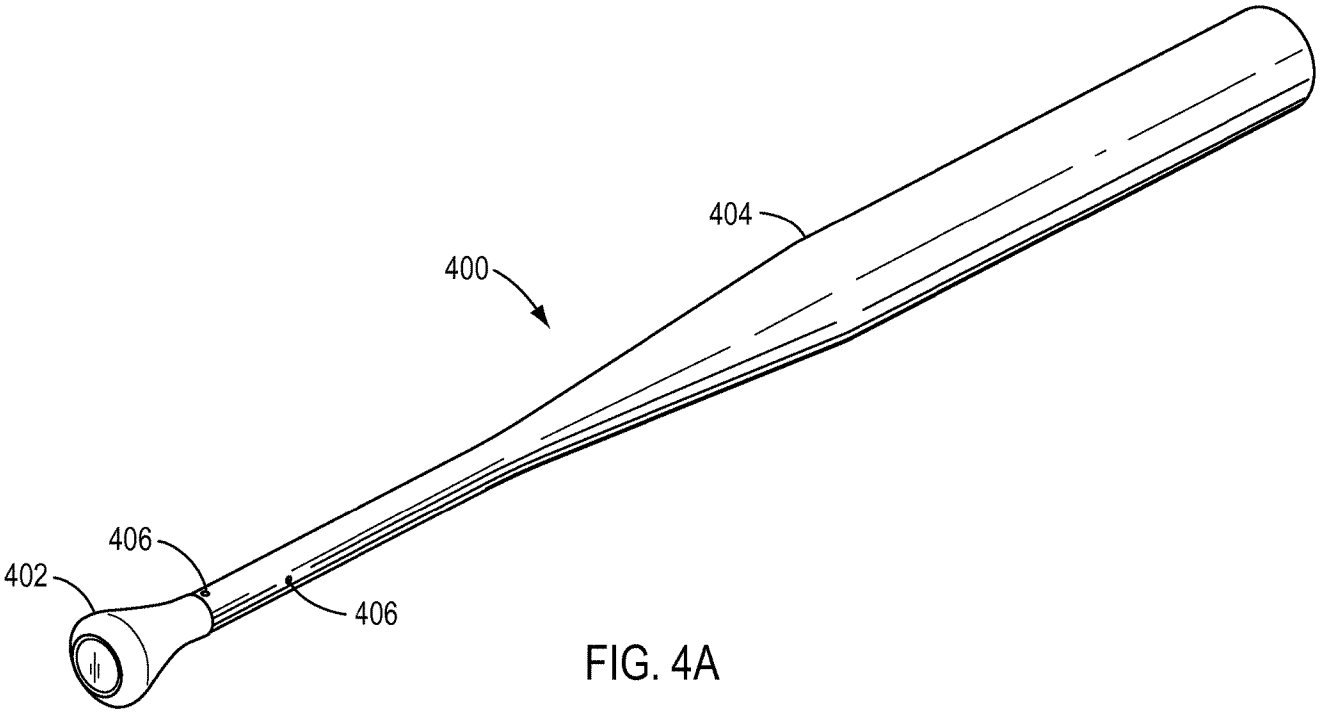
FIG. 4A shows an exemplary embodiment of a bat including a weighted knob and handle in accordance with the present teachings.
Figure 4B:
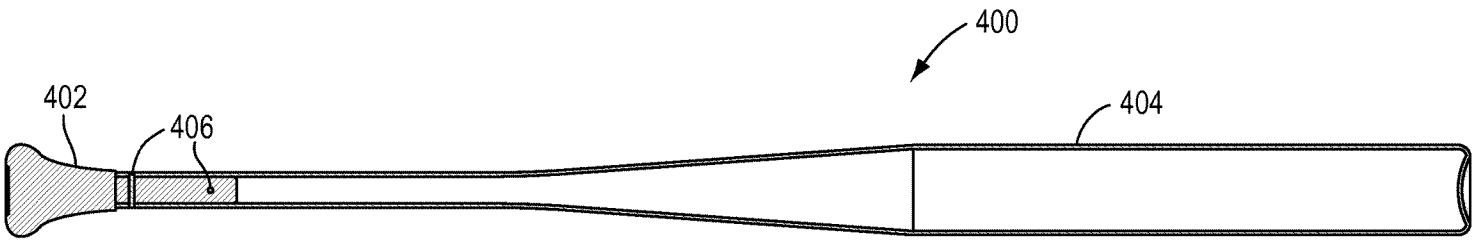
FIG. 4B shows a cross-sectional view of the bat of FIG. 4A showing the engagement of the bat and weighted knob and handle and the mechanism for interconnecting the bat barrel and weighted handle and knob in accordance with the present teachings.
Figure 4C:
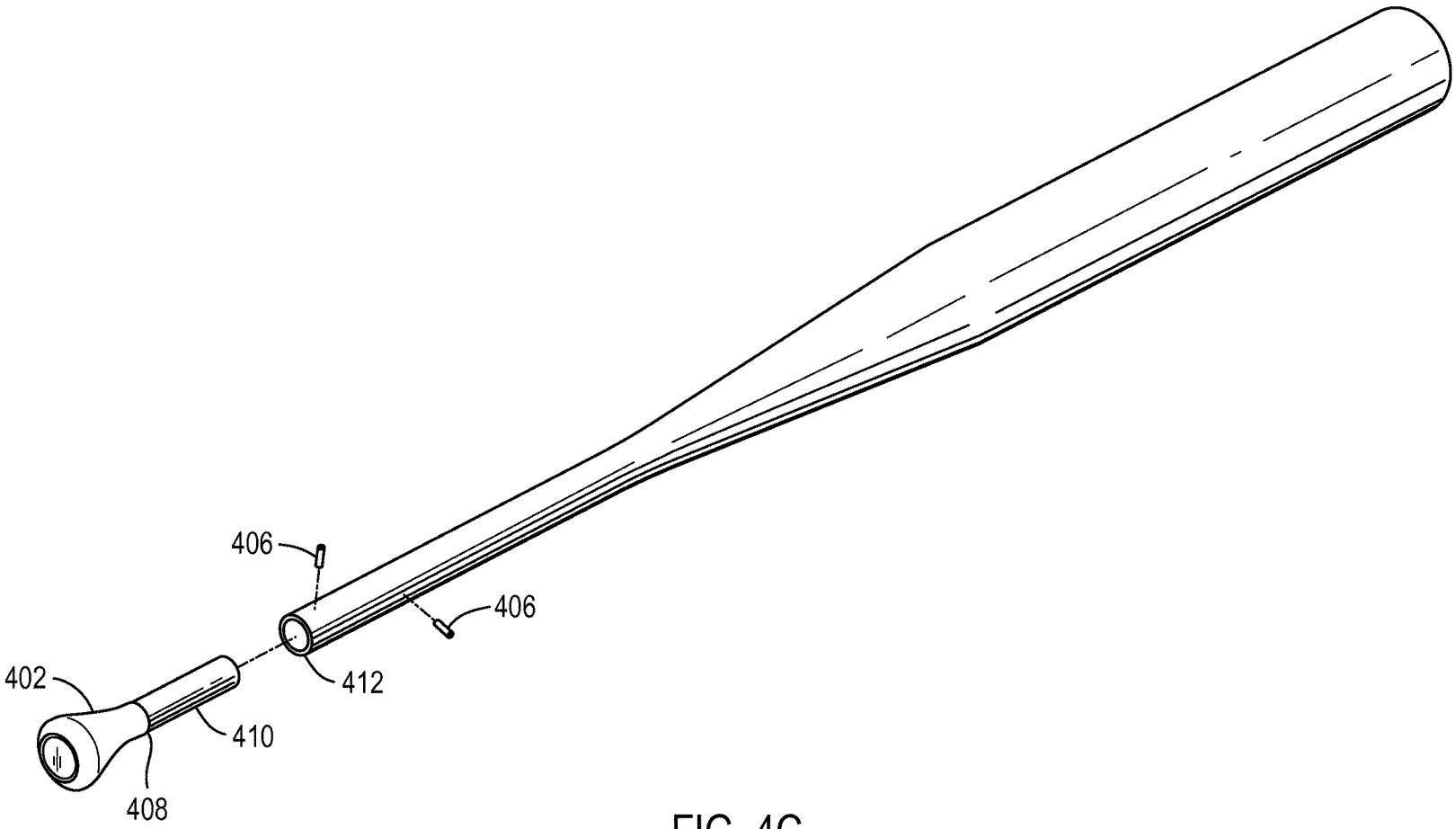
FIG. 4C shows an exploded view of the bat and weighted handle and knob of FIG. 4A in accordance with the present teachings.

FIGS. 4A-4C illustrate an exemplary embodiment of a handle weighted bat 400 wherein the weighted handle and knob 402 are manufactured as a single, integral component. FIG. 4A illustrates the bat 400 completely assembled. FIG. 4C depicts bat 400 prior to assembly. In comparison to some conventional heavy handle weighted bats wherein the handle assembly comprises three or more individual components, such as a knob, a thread connection and a rod, these bats frequently failed upon impact with a ball. The location of the break is almost invariably at the thread connection, thereby allowing the knob to separate from the rod.

Bat 400 in FIGS. 4A-4C illustrates a weighted handle and knob 402 formed as a single unit designed to eliminate the weak areas of a conventional handle assembly comprising three or more individual components. The single unit design combines the knob and the rod and eliminates the need for any threaded components. In addition, in various embodiments, the weighted handle and knob 402 is forged from a single unit of carbon steel, assuring maximum strength.

In various embodiments, the handle weighted portion comprises a one-piece, solid body construction that may be formed by impression die forging of a single piece of carbon steel to form an integral knob and rod portion. Forging is usually the most energy efficient means of producing a mechanically strong product. Other techniques do not achieve the same microscopic flow and texture that follow the outer contours of the object of manufacture. Forging refines the grain structure and improves physical properties of the metal. Matching the fine grained microscopic structure with the lines of force experienced within a material are an essential key to making mechanically strong lightweight materials. After the impression die forging process, a chrome plated layer may be applied to the entire surface of the carbon steel. Although impression die forging is described herein, the handle and knob can be manufactured from other forging techniques such as cold forging, open die forging, and seamless rolled ring forging.

Another advantage is that by eliminating the threaded component, a diameter of the rod consisting of a solid material, such as solid steel, can be manufactured. Thus, the solid, non-threaded steel is inherently much stronger than the threaded component. Furthermore, the threading process causes weakening to occur for metal rods of any diameter. FIG. 4B depicts the engagement of the barrel portion 404, the weighted handle and knob 402 and the connecting mechanism 406. The engagement of these components provides a generally continuous exterior surface of the baseball bat at the handle portion. This is because the diameter of the weighted handle and knob at point 408 mates the diameter of the tapered section 412 of the bat. In the example shown, the connecting mechanism 406 comprises a pair of spring pin connections.

During assembly, rod 410 is inserted into the hollow end 412 of the barrel portion of the bat. A pair of bores is drilled through the overlapping portion of the bat and the rod. Then, a pair of spring pin connections 406 is inserted into the bore to rigidly connect the barrel portion to the rod portion. As shown in FIG. 4B, each spring pin is located at opposite ends of the rod 410. The pair of spring pins is oriented at a 90 degree angle relative to each other. Interconnection of the barrel portion 404 and the weighted handle and knob 402 causes the components to tightly fit together to eliminate a weak breaking point in a heavy weighted handle bat.

Figure 4D:
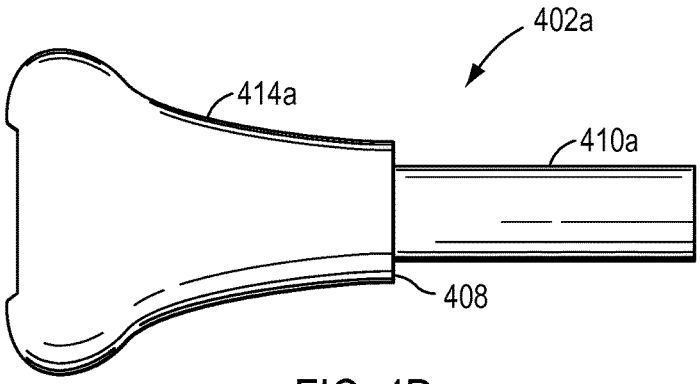
FIG. 4D shows an exemplary weighted handle and knob for use with the bat of FIG. 4A.
Figure 4E:
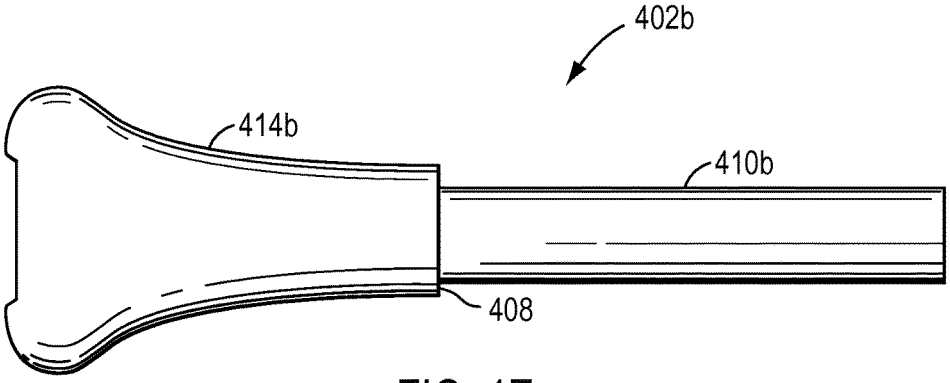
FIG. 4E shows another exemplary weighted handle and knob for use with the bat of FIG. 4A.
Figure 4F:
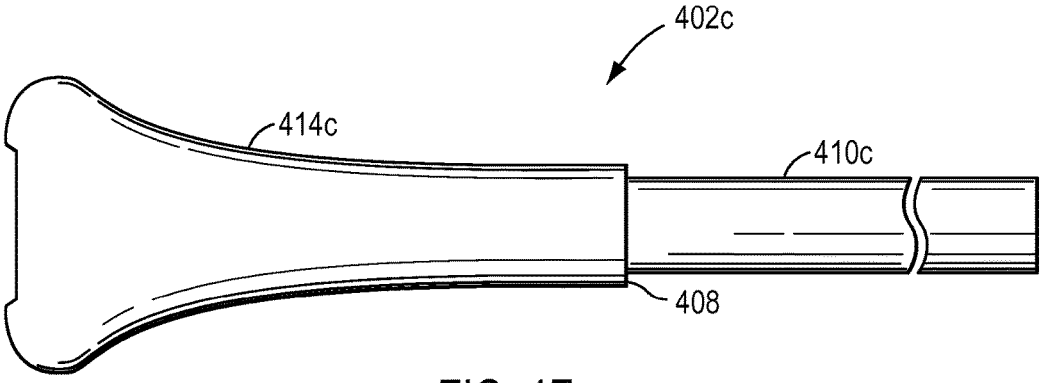
FIG. 4F shows yet another exemplary weighted handle and knob for use with the bat of FIG. 4A.

FIGS. 4D-4F depict the weighted handle and knob 402 can be manufactured having a variety of configurations. To obtain the desired heavy handle construction, the dimensions of the knob and/or rod can be varied during the manufacturing process. As shown in FIGS. 4D-4F, the weighted handle and knob 402 (FIGS. 4A-4C) may be made in a variety of sizes corresponding to different sizes and/or weights of bats. For example, the weighted handle and knob 402*a* in FIG. 4D is shown having a relatively short length rod 410*a* and a short knob 414*a*. Another example is that the weighting handle and knob 402*b* in FIG. 4E is shown having a medium length rod 410*b* and medium length knob 414*b*. A further example is that the weighted handle and knob 402*c* in FIG. 4F is shown having an elongated rod 410*c* and an elongated knob 414*c*.

In the example shown, the diameter of rod 410*a*, 410*b*, 410*c* is configured to be smaller than the minimum diameter at point 408 of knobs 402*a*, 402*b*, 402*c*. Namely, the configuration of the knob has a stepped-down portion at point 408 which defines the diameter of the rod having a reduced profile.

As shown in FIGS. 4D-4F, the shape of the knobs 414*a*, 414*b*, 414*c* can be tapered outwardly or gradually flared into a bell shape to enable the user's hands to grip or fully encircle the heaviest portion of the weighted handle and knob at the distal end. When swinging a bat, hand position in the swing is very important to provide better control of the bat. The hand position enables the user to effectively impact the barrel of the bat to the baseball and control the direction and trajectory of the baseball.

In various embodiments, the handle weighted device can be made of a hybrid construction wherein a portion of the device consists of one material and another portion consists of a different material. In the examples shown in FIGS. 4A-4F, the bat can be designed as a hybrid bat comprising two different metals. For example, the barrel of the bat 404 may consist of aluminum and the weighted handle and knob may consist of steel. This is merely exemplary. Those having skill in the art would recognize various bats having different material combinations can be manufactured within the spirit of the present teachings.

Figure 5A:
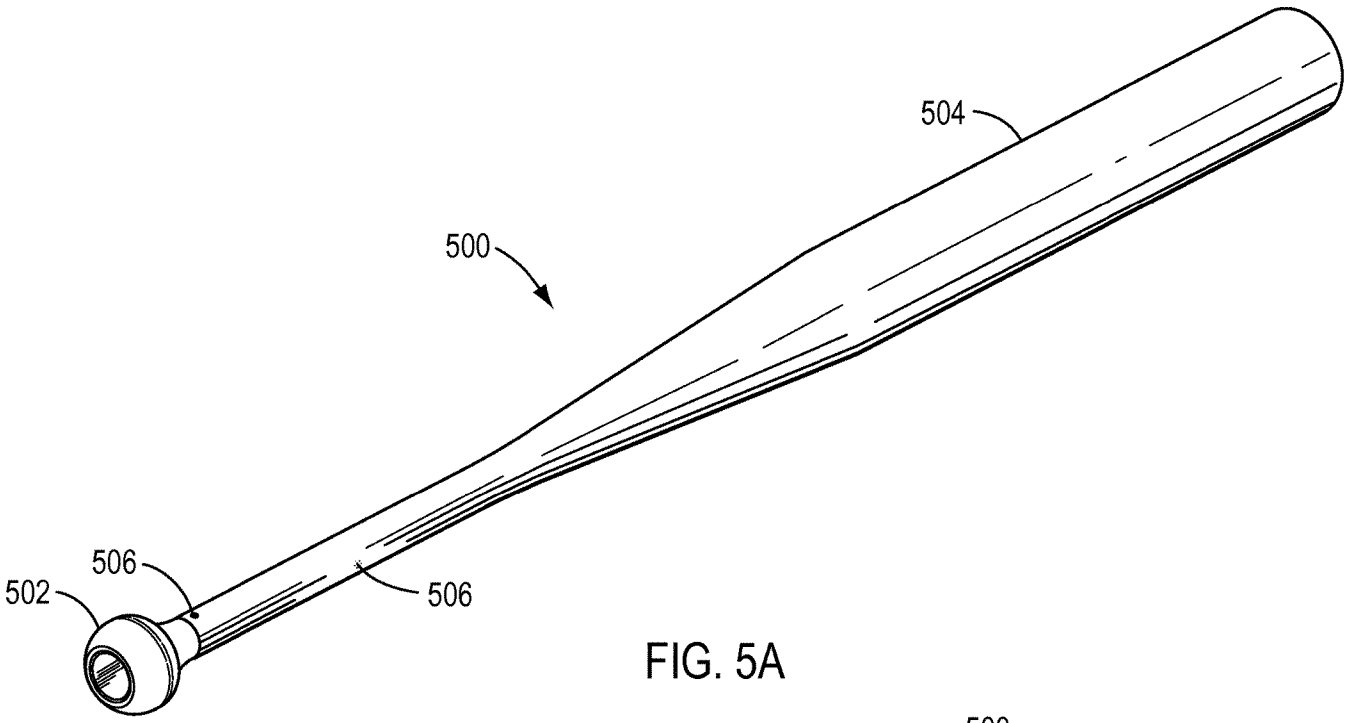
FIG. 5A shows another exemplary embodiment of a bat including a weighted knob and handle in accordance with the present teachings.
Figure 5B:
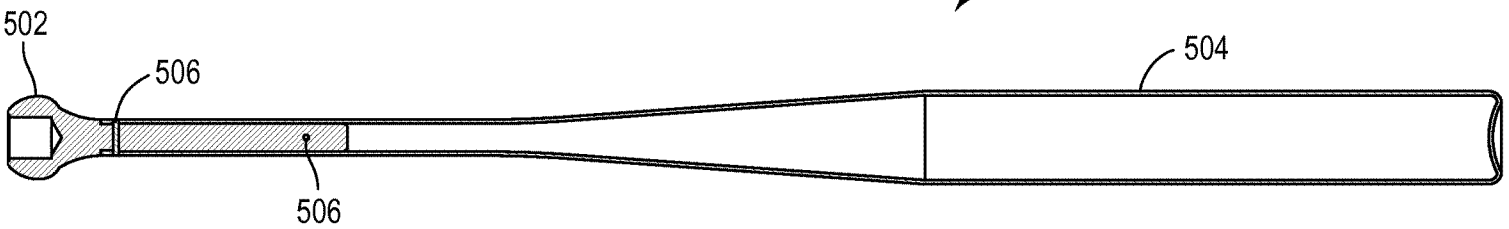
FIG. 5B shows a cross-sectional view of the bat of FIG. 5A showing the engagement of the bat and weighted knob and handle and the mechanism for interconnecting the bat barrel and weighted handle and knob in accordance with the present teachings.
Figure 5C:
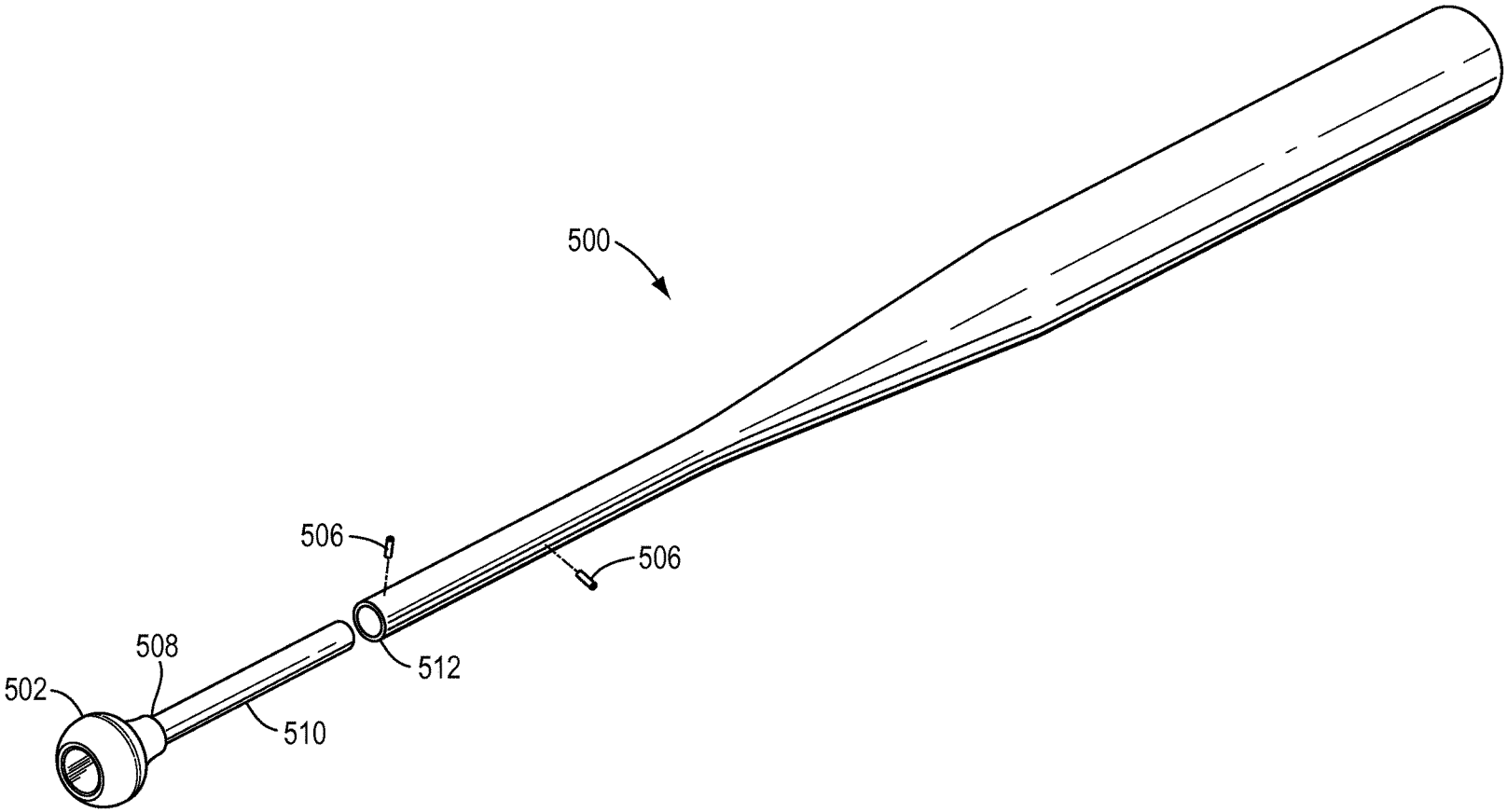
FIG. 5C shows an exploded view of the bat and weighted handle and knob of FIG. 5A in accordance with the present teachings.

FIGS. 5A-5C illustrate another exemplary embodiment of a handle weighted bat 500 wherein the weighted handle and knob 502 are manufactured as a single, integral component similar as described above with regards to FIGS. 4A-4C. FIG. 5A illustrates the bat 500 completely assembled. FIG. 5C depicts bat 500 prior to assembly.

FIG. 5B depicts the engagement of the barrel portion 504, the weighted handle and knob 502 and the connecting mechanism 506, which provides a generally continuous exterior surface of the baseball bat at the handle portion. The diameter of the weighted handle and knob at point 508 mates the diameter of the tapered section of the bat at point 512, such that during assembly rod 510 is inserted within the bat.

In the examples shown, the connecting mechanism 506 comprises a pair of spring pin connections. During assembly as shown in FIG. 5C, rod 510 is inserted into a hollow end 512 of the barrel portion of the bat. A pair of bores is drilled through the overlapping portion of the bat and the rod. Then, a pair of spring pins connection 506 is inserted into the bores to rigidly connect the barrel portion to the rod portion. Each spring pin is located at opposite ends of the rod 510. The pair of spring pins is oriented at a 90 degree angle relative to each other. Interconnection of the barrel portion 504 and the weighted handle and knob 502 causes the components to tightly fit together to eliminate a weak breaking point.

Figure 5D:
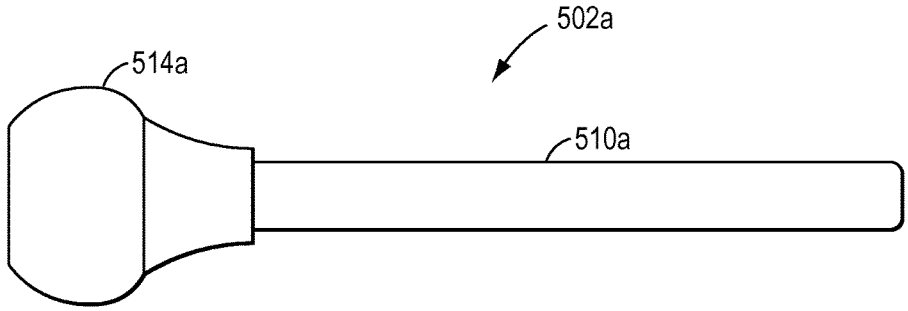
FIG. 5D shows an exemplary weighted handle and knob for use with the bat of FIG. 5A.
Figure 5E:
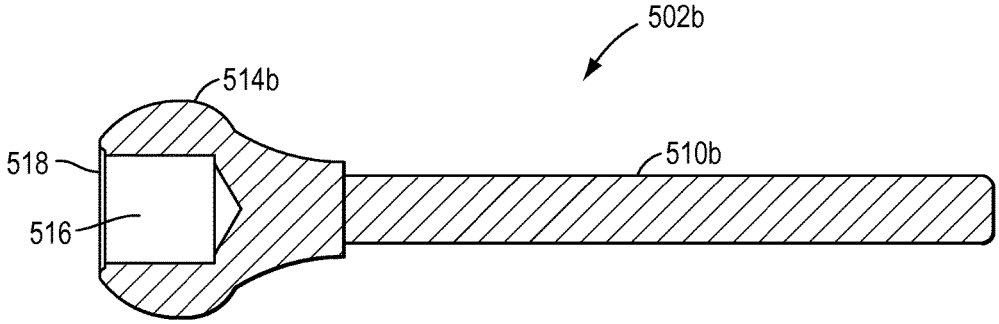
FIG. 5E shows another exemplary weighted handle and knob for use with the bat of FIG. 5A.
Figure 6:
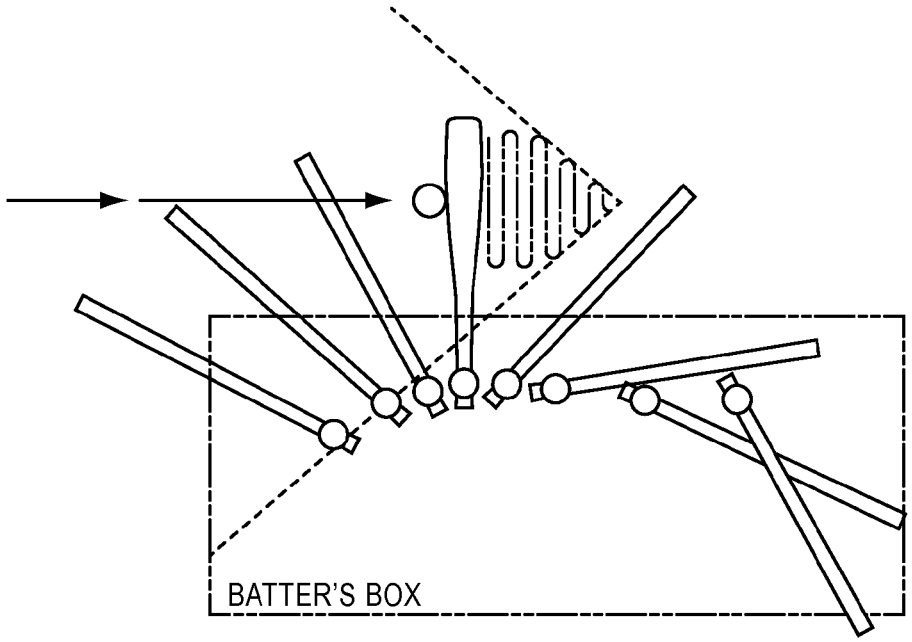
FIG. 6 shows a top view diagram of a batter's hand path in the batter's box where linear batting dynamics are employed to hit the ball.

FIGS. 5D-5E depict the weighted handle and knob 502 manufactured having various configurations. As shown in FIGS. 5D-5E, the weighted handle and knob 502 (FIGS. 5A-5C) may be made in a variety of sizes corresponding to different sizes and/or weights of bats. In the embodiments in FIGS. 5D-5E, the knob can be formed as having either a hollow or solid shape. For example, the weighted handle and knob 502*a* in FIG. 5D is shown having a solid spherical knob 514*a*. A rod 510*a* integrally extends from the solid spherical knob 514*a*. In the example in FIG. 5E, to obtain the desired weight, the knob 514*b* is formed with a hollow bore 516. The size of the hollow bore can be determined based upon the desired weight of the handle and knob unit. An enclosing mechanism 518, such as a plate or plug, can be installed onto the knob 514*b* to cover the opening of the bore 516. Thus, in FIGS. 5D-5E, the knob may present the appearance of a truncated spherical body having at least one truncated side to resemble a shape of a substantially round ball.

The various embodiments of the bats described according to the present teachings can be made more versatile in a modular format that will allow the user to increase or decrease the unit weight of the bat by swapping handle inserts of varying sizes. The inserts can be made of iron, stainless steel, a combination thereof, or any other practice metal or alloy construction and can be replaceably fastened into the end of either the training bat or weighted bat, for example, with a screw thread feature, a friction/suction element, or through a snap on/in design.

Figure 8:
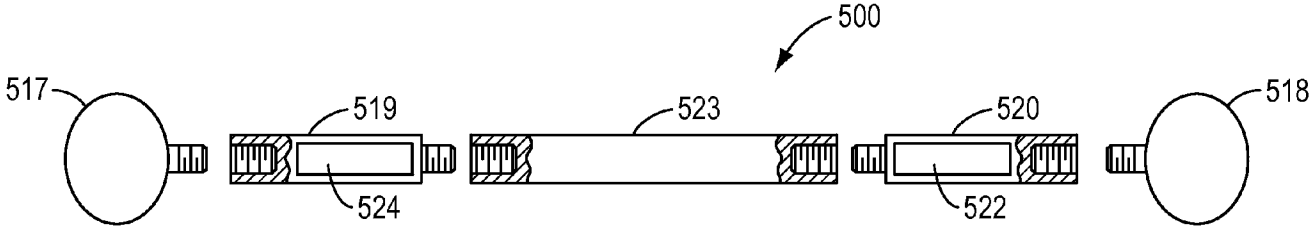
FIG. 8 shows a modular practice and warm up bat with interchangeable components in accordance with the present teachings.

In FIG. 8, a modular alternative embodiment of a dual handle weighted training bat 500 is shown having weighted removable and interchangeable knobs 517 and 518, removable and interchangeable length handles 519 and 520, removable and changeable weights 521 and 524 and interchangeable length rod 523. While threaded connections are shown between the modular elements of the training bat, those having skill in the art would understand that other means to provide releasable connections between these elements are contemplated. The various potential configurations due to the interchangeability of the training bat provides the ability to custom fit the training bat according to the swing adjustment needs of each potential customer.

Figure 9A:
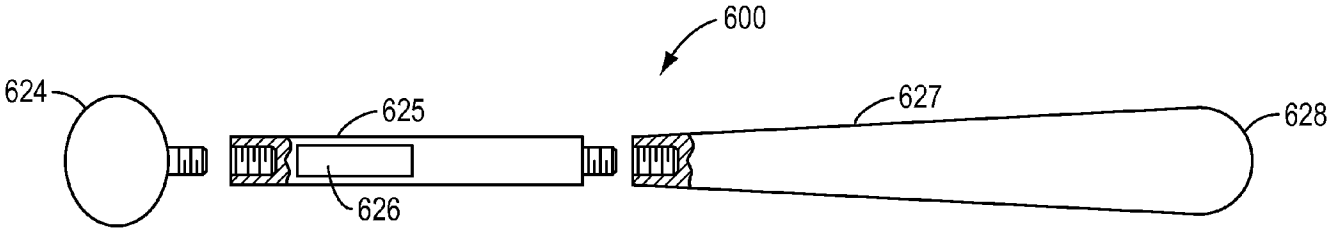
FIG. 9A shows a modular handle weighted bat with interchangeable components in accordance with the present teachings.

In FIG. 9A, a modular alternative of the handle weighted bat 600 is shown having weighted removable and interchangeable knob 624, an interchangeable length handle 625, an interchangeable weight 626, an interchangeable barrel 627 having an end cap 628. As with the modular dual handle training bat 500 the threaded connections are shown between the modular elements of the handle weighted bat 600 but other means to provide releasable connections between these elements are also contemplated. The flexibility of the potential configurations between the modular elements of the handle weighted bat 600 provides the ability to custom fit the bat according to the swing adjustment needs of potential customers. The handle member 625 can be constructed of aluminum steel, graphite or aluminum or any other suitable material. The barrel element 627 can be constructed of aluminum, wood or any other material approved for use in a baseball bat.

Figure 9B:
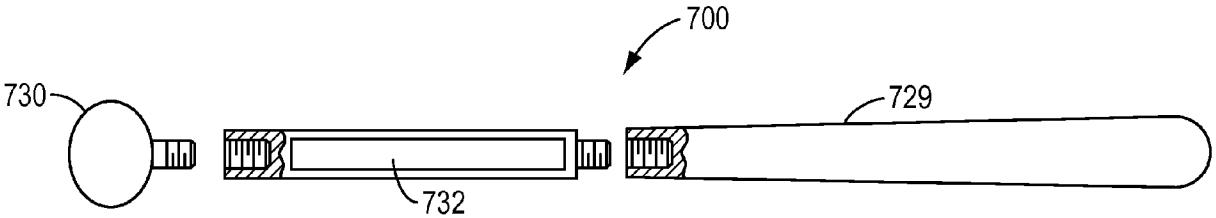
FIG. 9B shows another exemplary embodiment of a modular handle weighted bat with interchangeable components in accordance with the present teachings.

In FIG. 9B, a modular bat 700 is shown where the barrel 729 has a smaller diameter than the barrel 627 in FIG. 9A. A knob element 730 is smaller than the knob 624 in FIG. 9A. Handle weight 732 is longer than the weight 626 shown in FIG. 9A. All of the bat elements shown in FIGS. 9A and 9B are designed to be interchangeable by compatible connection means to expand the customizing ability of the batting system.

Figure 9C:
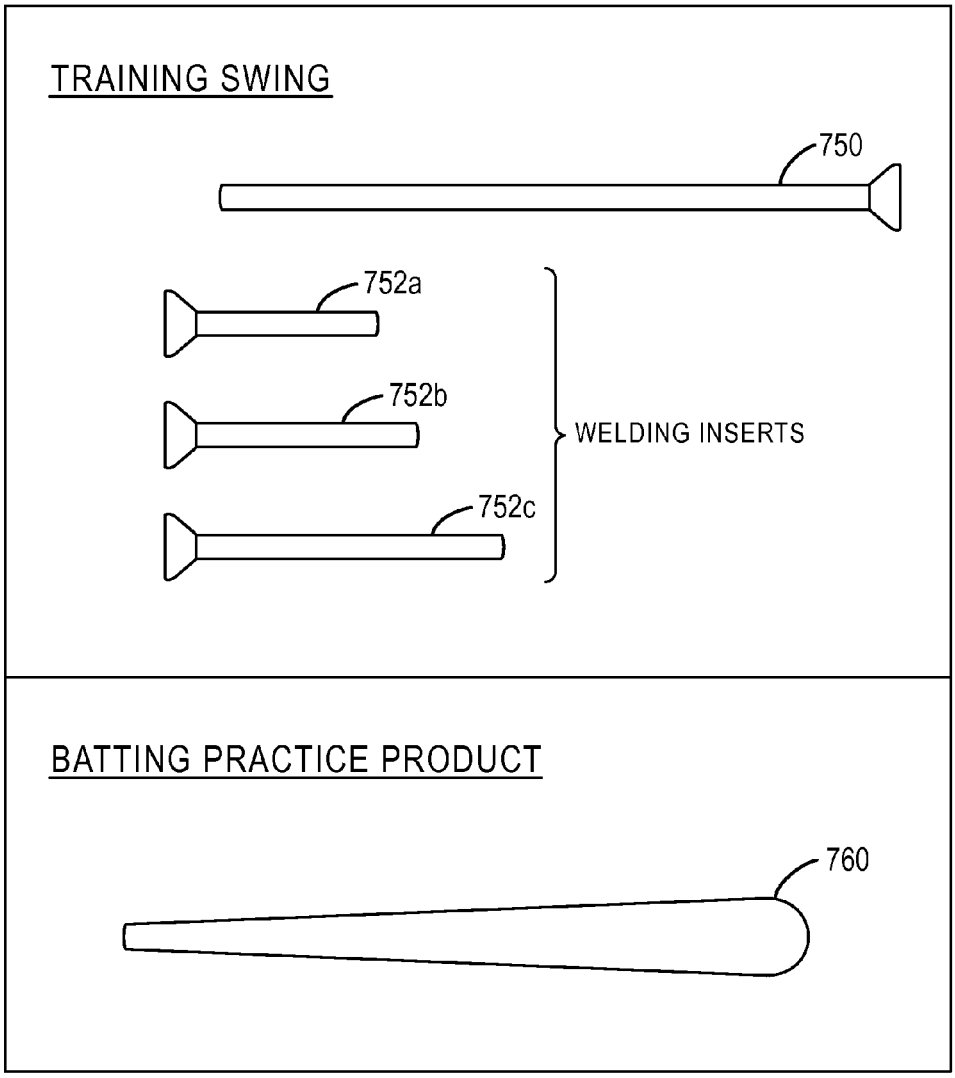
FIG. 9C shows another embodiment of a practice bat and a handle weighted bat with interchangeable knob-and-handle weighted inserts in accordance with the present teachings.

The exemplary embodiment of FIG. 9C illustrates another embodiment of the training bat 750 that includes interchangeable knob-and-handle weighted inserts 752*a*, 752*b*, 752*c*, wherein the knob is manufactured as an integral part of the weighted inserts. The knob-and-handle weighted inserts 752*a*, 752*b*, 752*c* can be manufactured having various weights, lengths or sizes. In the example shown in FIG. 9C, the knob-and-handle weighted inserts are shown having various lengths, which can be interchanged to vary the handle weight of the training bat 750. The knob-and-handle weight inserts are usable in both the training bat 750 and the weighted bat 760. Thus, the knob-and-handle weighted inserts 752*a*, 752*b*, 752*c* can also be interchangeably inserted into the weighted bat 760.

Figure 10:
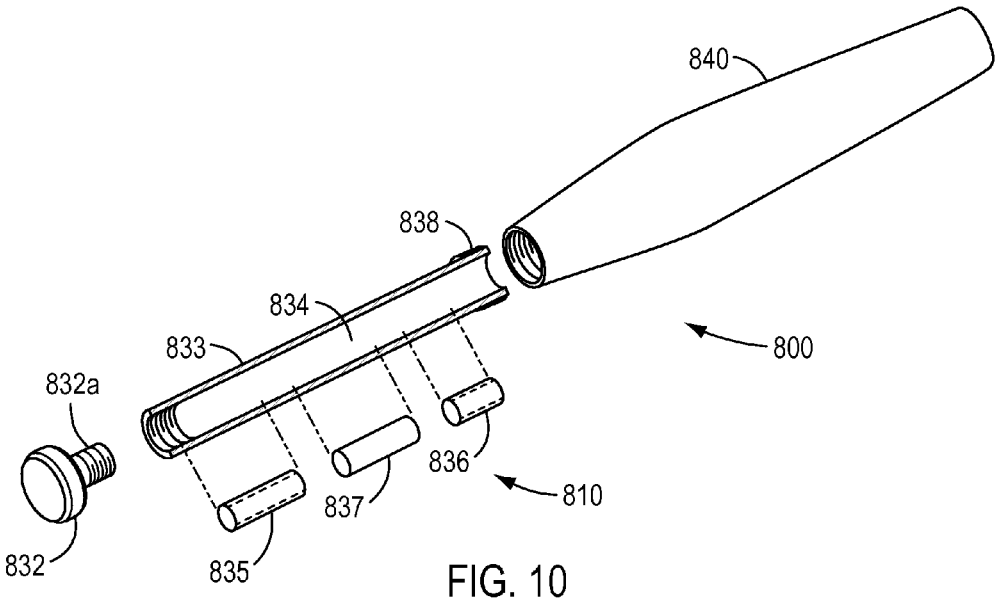
FIG. 10 is an exemplary embodiment illustrating the modular handle weighted bat being fitted with different sized weights.

FIG. 10 provides an alternative system for changing the weights that mounted within the weighted bat handle or the dual handle training bat. While the handle weights can be installed within the modular training bat and the modular bat, FIG. 10 shows a more flexible system that may make replacing the handle weights more convenient. In FIG. 10, a sleeve arrangement 810 that slides onto and along a rod 834 provided within the bat's handle 833 is shown. The sleeve arrangement 810 may include at least one sleeve element 835, 836 that functions as spacers to securely position the handle weight 837 at a desired location along the rod 834. The batting system 800 may include a weighted knob 832 that has an extension 832*a* that has a threaded female surface inside this extension. A rod element 834 has first and second end portions having male threaded portions that engage the female threads of knob extension 832*a* at the first end and the second end of rod 838 engages a female fitting secured at the end of handle 833. Alternatively, the second end 838 of rod 834 can be arranged to engage a female fitting mounted in the barrel element 840. Sleeve elements 835 and 836 are designed to slide over the first and second threaded end portions of rod 834. Handle weight 837 is also designed to slide over the first and second threaded portions of rod 834. The sleeves 835 and 836 and the handle weight 837 can be arranged along rod 834 in the handle 833 as follows. The selected weight and its location along the handle member 833 are first determined. The length of sleeve members 835 and 836 are selected so that the weight element 837 is positioned in the desired position along the length of rod 834. The sleeves are also designed with a wall diameter that will abut the extension 832*a* of knob member 832. When the sleeves 835 and 836 and the weight 837 are in place as shown in FIG. 10 and the knob 832 is tighten, it will compress the sleeves and weights together to provide a secure mounting of the weight 837 in handle 833. It should be noted that if desired a weight of sufficient length could be mounted in handle 837 without any sleeves if the weight is long enough to engage the knob extension 832*a*. It may also be desirable to use only one sleeve to properly locate the weight 837 in handle 833.

Figure 11:
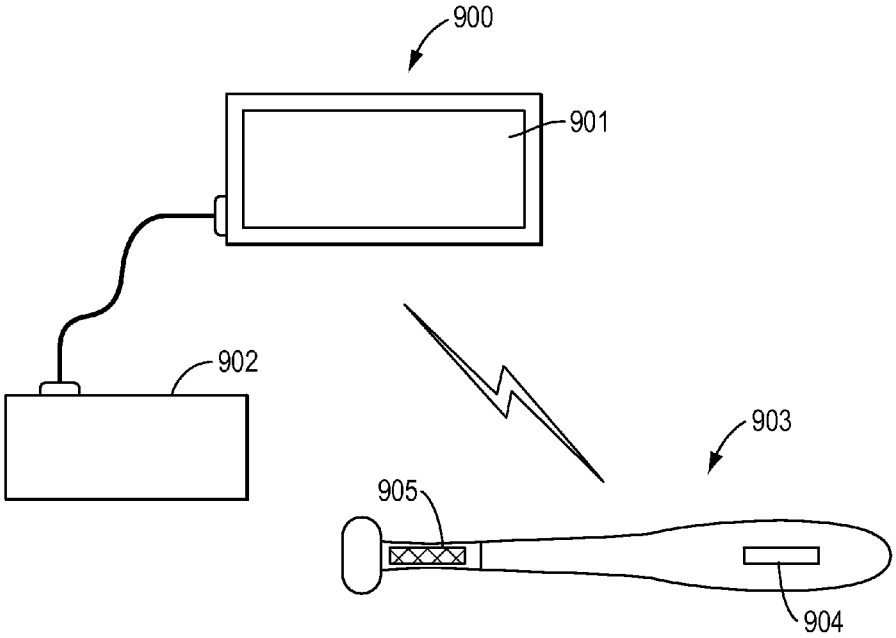
FIG. 11 depicts a handle weighted bat selector system in use with a video gaming system.
Figure 15:
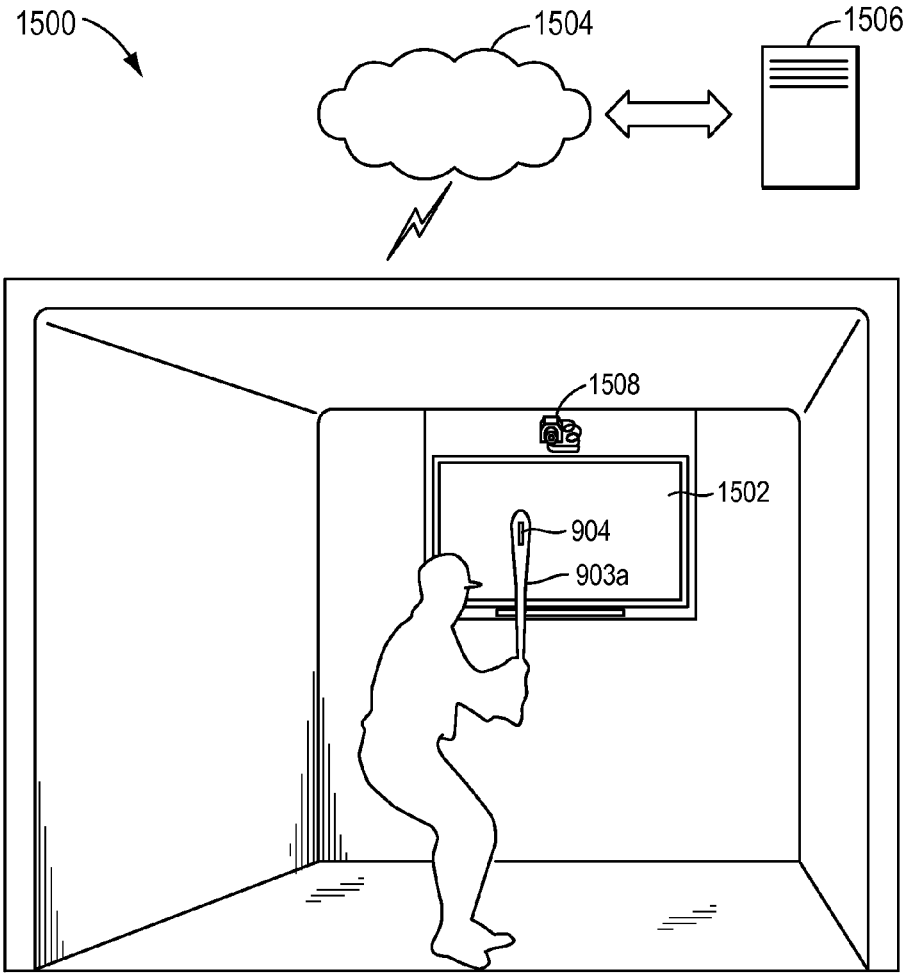
FIG. 15 depicts another embodiment of the handle weighted bat selector system in use with a video gaming system.

FIGS. 11 and 15 illustrate an electronic embodiment of any one of the bats described above employed in use, for example, with a video gaming system. The various parts of the batting system 900, 1500 and/or bats can be configured with electronic components 905, such as, for example, electronic sensors, microprocessors, and network connectivity capabilities for detecting, transmitting and processing data. Thus, the batting system may be integrated into many different technological platforms. The batting system 900 and 1500 may be integrated with a video game system as a means for providing a testing and custom fitting system where a hitter's swing dynamic can be measured and observed to determine the best fit equation for the hitter to assist each hitter with selecting his optimum bat weight for a handle weighted bat. A video gaming system has been defined as an interactive entertainment computer or electronic device that produces a video display signal which can be used with a display device (a television, monitor, etc.) to display a video game or directly on a portable device like a smart phone or PDA (Personal Digital Assistant). For example, embodiments provide for using the batting system 900 and 1500 with video games, personal computers, netbooks, smartphones, and portable wireless devices. As a non-limiting example, the batting system 900 and 1500 may be integrated into haptic devices such as the WII™ video game controller for the video game system by Nintendo Company Limited. Another example of use of the batting system 900 and 1500 may involve integrating the batting system such that it is capable of interacting with the KINECT™ video game system for the XBOX™ 360 video game system by the Microsoft Corporation. Furthermore, a growing number of video games rely on smartphone and tablets as a video gaming system, which can also be used in conjunction with batting system 900.

FIG. 11 depicts a batting system 900 wherein an electronic handle weighted bat 903 is coupled with a video gaming system 902, such as a Nintendo WII™. The video gaming system 902 is connected to a TV 901. The electronic bat 903 is configured with an electronic components module 905 to function similar to a wireless game controller. To facilitate pose tracking, the bat 903 may include one or more markers 904, such as a barcode or accelerators. Many of the known video games use a video camera to track a user's position. Pose tracking is a computer vision technique that traces movement of body parts based on the input of video cameras. Pose tracking can also be achieved by attaching accelerometers to body parts or objects of interest and integrating their signals. In this example, pose tracking information can be used to determine the optimum bat weight for the hitter by identifying and calculating parameters, such as the circular hand path, conservation of momentum, combined momentum and restitution, center of gravity, moment of inertia, ball speed, maximum-ball-speed bat weight, and determining a best fit curve to the data, as described, for example, in U.S. Pat. Nos. 5,118,102 and 5,672,809, the contents of which are incorporated by reference herein. Accordingly, the batting system can use a Web camera coupled with a video gaming system, a phone camera, a notebook camera, or a camera integrated into the gaming system for motion or pose tracking. In some embodiments, the batting system may include accelerometers that transfer information over a network to trace the user's position.

Figure 16:
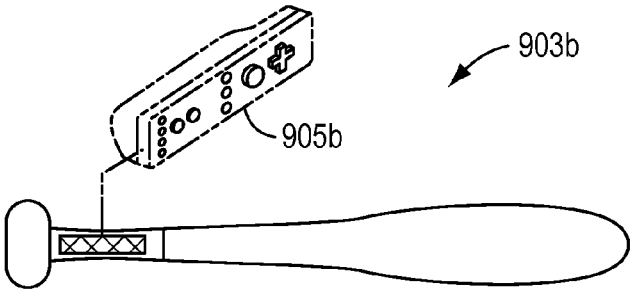
FIG. 16 depicts a game controller installable within a simulated bat configured to interact with the handle weighted bat selector system and video gaming system.

The batting system can monitor the above parameters, automatically determine by the processor of the video gaming system the optimum bat weight, and suggest to the user to adjust the bats configurations, such as weight or length. In some embodiments, the batting system aggregates the user's batting swings to record and compile the user's batting history. Due to the versatility and portability of the various components, the batting system 900 can be easily configured to interact with multiple types of video gaming systems to enable indoor and outdoor usage. For example, a personal computer equipped with a web camera can be employed for indoor use, and a smartphone or tablet can be used for outdoor activities. During use, in one embodiment, the user may initially assemble the handle weighted device with the desired features such as a specific weighting element, knob weight, rod or barrel length, and/or bat composition. The user may enter within an input device of the batting system the above described initial set-up information, may enter the desired outcome, such as a specific swing speed, may enter specific physical characteristic of the user, such as height and weight, whether the user is a left-handed or right-handed hitter and may enter the configuration for the ball. Then, the batting system 900 automatically calculates the initial set-up configuration of the weighted handle device. The batting system 900 can be programmed to operate in an actual device mode or a video gaming mode. In the actual device mode, the electronic components module 905*a* (FIG. 12) can be housed within a sleeve 906, which is temporarily attachable as one of the interchangeable components of an actual modular device 903*a*. In the video gaming mode, the electronic components can be installed in a wireless game controller 905*b* (FIG. 16). In all embodiments, pose tracking devices can be attached to the hitter to transmit information regarding the physical characteristic of the user to the batting system during use.

Figure 12:
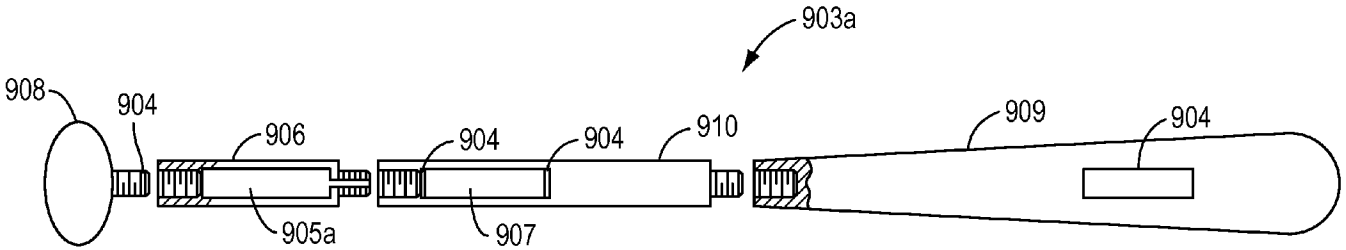
FIG. 12 depicts a handle weighted bat configurable to interact with the handle weighted bat selector system and video gaming system.

FIG. 12 illustrates an embodiment of an actual handle weighted device 903*a*, depicted as an actual bat, which is configurable to interact with a gaming console. In the exemplary embodiment in FIG. 12, the actual handle weighted device 903*a* includes interchangeable components, such as barrel 909, handle 910, electronic component sleeve 906, weighting element 907, and knob 908, which can be interchanged with other components of various lengths, weights or designs to form various potential configurations, as described above. The electronic component sleeve 906 can be outfitted to house the electronic components 905*a*. As shown in FIG. 12, the electronic component sleeve 906 can be temporarily attached to the device 903*a*, for example, by a screw or snap-on attachment between the weighting element 907 and the knob 908 to detect and determine parameters such as the weight and speed of the bat.

Figure 14:
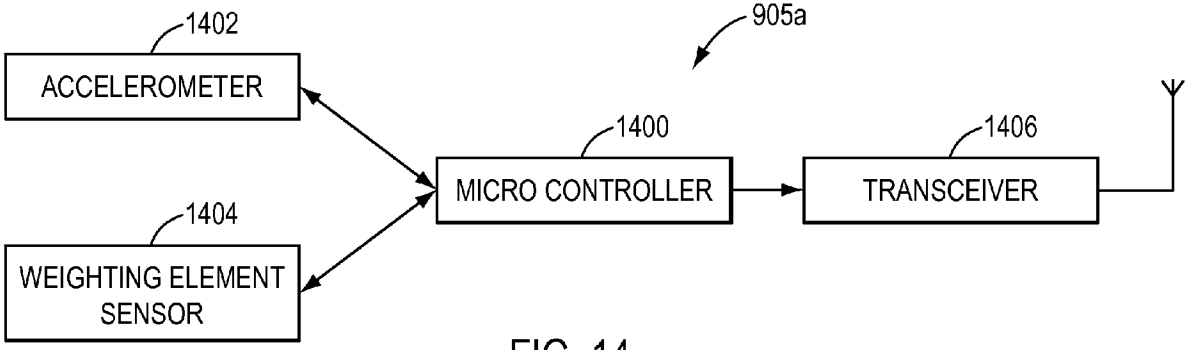
FIG. 14 is a block diagram of exemplary electronic components in accordance with the present teachings.

A block diagram of the exemplary electronic components module 905*a* is shown in FIG. 14. The module can include various sensors for measuring the speed and weight of the bat. For example, the system can include a speed and weight module for measuring the speed of the bat and the total weight of the bat. In some embodiments, the electronic components module 905*a* can be configured as a microelectromechanical systems (MEMS) outfitted with a microcontroller 1400, an accelerometer 1402, a weighting element sensor 1404, and a transceiver 1406 and other sensors to communicate via a wireless transmitter. Other additional sensors may be included in the electronic components module depending upon the design and application of the device. For example, the additional sensors may include strain gauges, piezoelectric devices and/or pressure transducers designed such that the load of the weighting element applied to the sensor can be used to indicate the weight of the weighting element. The microcontroller 1400 can be preloaded with a table of values that allows it to calculate the weight of the weighting element based upon the load applied to the sensor. The electronic components module 905*a* can be powered by a battery (not shown) contained in the electronic component sleeve 906. The module of the electronic components is capable of communicating wirelessly with any device containing a processor, such as a PC, a PDA, a notebook, a tablet, and a laptop. The wireless protocol used can be Bluetooth, WIFI or Zigbee. The microcontroller 1400 communicates with the accelerometer 1402, weighting element sensor 1404 and the transceiver 1406. Once the electronic component module 905*a* is wirelessly connected to a network (FIG. 15), the data is transmitted from the transceiver 1406 to the server 1506 where it can be processed.

As shown in FIG. 12, in the actual device mode, an actual handle weighted device 903*a*, such as an actual bat that can be used to play a sport such as baseball or softball is configured to receive pose tracking devices such as an accelerator and/or barcode and transmit detected information to the batting system. To track and transmit movement information, the pose tracking devices can be temporarily attached as a marker 904 to the external portion of the handle weighted device, for example, by way of clips, Velcro, an elastic strap, or inserted within a pocket or slot of a sleeve attached to the device. In various embodiments, the marker 904 can include a barcode to detect information regarding the weighting element or an accelerator to measure the speed of the bat. In some embodiments, the marker 904 is designed as a combination of at least a barcode and an accelerator. In some embodiments, a compartment can be provided along the side of the handle or at the knob for securely inserting one or more pose tracking devices. In other embodiments, the pose tracking devices may be inserted within a receiving slot provided in the device.

Figure 13:
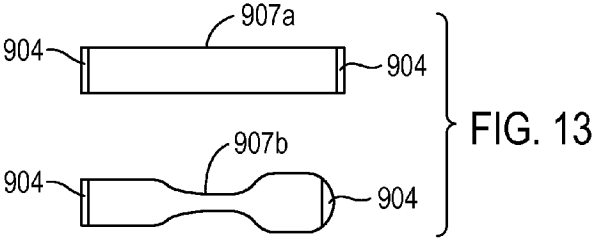
FIG. 13 illustrates examples of different weighting elements in accordance with the present teachings.

In FIG. 12, electronic components module 905*a* can automatically detect the weight and geometry of the weighting element to provide data to the system to calculate the moment of inertia around one or more components of the handle weighted device. As illustrated in FIG. 13, the weighting element can be solid, hollow, of different sizes of uniform shapes 907*a* or of non-uniform shapes 907*b*. The weight, position and geometry of the weighting element are variables that may be used by the system to calculate the moment of inertia. The physics and engineering equations of hitting a baseball are well-known and are incorporated by reference herein. The electronic components and sensors 905*a* can be strategically positioned within the handle of the device to detect each of these variables to calculate the moment of inertia and to detect variations in the weights and the center of gravity.

Using the various sensors attached to the bat, attached to the hitter and included within the electronic components module 905*a*, the system 1500 can monitor and measure the various parameters, such as the speed of the bat, the weight of the bat, and the moment of inertia. As shown in FIGS. 12 and 13, the system may include one or more identifier markers 904 attached to various components to detect these parameters. The markers 904 can be adhered to external components of the handle weighted device and to the internal components of the handle weighted device. As shown in FIGS. 12 and 15, external markers 904 can be attached, for example, to the barrel 909. Camera 1508 (FIG. 15) can be configured with barcode reader features and capabilities. The camera can use any known camera and image processing techniques to decode the data contained within marker 904 attached externally to the device 903*a*.

In FIGS. 12 and 13, internal markers 904 can be attached to the weighting element 907, 907*a*, and 907*b* and the screw of the knob 908 inserted within the handle 910. When the electronic component sleeve 906 is attached to the device 903*a*, the weighting element sensors 1404 of the electronic components 905*a* are positioned to directly contact the markers 904 of the weighting element 907 and the screw of the knob 908 to detect the weight of the weighting element and the knob. The marker 904 may include data, which can be read by the sensors 1404, to indicate the values representing the weight and shape of the weighting element 907 and knob 908 and for non-uniform weights 907*b* the orientation of the weight within the handle 910. As shown in FIGS. 12 and 13, the markers 904 can be attached to both ends of the weighting elements 907, 907*a*, and 907*b* so that the markers can be read by the sensors regardless of the orientation of the weighting element within the handle.

To determine the total weight of the handle weighted device 903*a*, the system 1500 receives and aggregates the data transmitted from all external markers 904 and the data contained in the internal markers 904 read by the electronic sensors 1404 and transmitted by the electronic components module 905*a* to the network. Accelerometers 1402 can be included in the electronic components 905*a* to measure the speed of the bat when the hitter swings the handle weighted device 903*a* (FIGS. 12, 14 and 15). Accelerometers can also be attached to the user, for example, using a strap having a Velcro™ attachment mechanism. The accelerometers may be integrated circuit accelerometers which are routinely incorporated into portable consumer devices, including smartphones, game controllers, and PDAs. The measured parameters can be sent wirelessly to the system and information, such as the total weight of the bat, the speed of the bat, the moment of inertia and any additional information can be displayed on the screen 1502.

In use, FIG. 15 depicts a batting system 1500 including an actual weighted handle device 903*a* coupled with a video gaming system 1502 having a touch-activated display screen and electronic control modules provided therein. The electronic control modules host the processor. During play, the electronic control module establishes a wireless connection over the Internet 1504 to an Internet server 1506. Camera 1508 provides video streaming information for the pose tracking, which is implemented, for example, on the electronic control module or a desktop computer. During use, a screen device, for example, of a television or a PDA device can project an image of a ball being pitched to the user at a specific velocity and angle. Rather than employing a wall-mounted camera 1508, in various embodiments, one or more cameras, for example, attached to the television or included within a smartphone, a PDA or a tablet device may be used to acquire a plurality of images of the hitter swinging the handle weighted device. Based upon the initial set-up parameters and user characteristics, the batting system 1500 simulates an impact between the ball and the actual weighted handle device 903*a*. Based upon the monitored parameters and characteristics, the batting system 1500 automatically determines by use of the processor the optimum bat weight, and suggests to the user to adjust the bat configurations, such as the weighting element and length or the user's hitting form, such as feet or hand position, angle of swing, and swing speed.

In the video gaming mode shown in FIG. 16 which can be used in conjunction with the batting system 900 in FIG. 11, the batting system can be programmed to receive input initial set-up information as described above regarding the actual device mode. Rather than using an actual weighted handle device 903*a* (FIG. 12), a game controller 905*b*, such as a WIT controller, can be installed in a simulated bat 903*b* and used to play a simulated game of baseball or softball. The controller 903*b* includes a variety of buttons for the user to press to control various aspects of the game displayed on a screen. The controller also uses accelerometer and optical sensor technology to sense the motion imparted by the user to accordingly manipulate images displayed on the game display screen. According to the present teachings, the controller also enables the user to enter the parameters of the desired initial set-up configuration of a weighted handle device in the video gaming system. The video gaming system 902 displays on the screen 901 *a* weighted handle device designed based upon the received information. The user may use the controller 905*b* to simulate a game of baseball or softball played with the simulated weighted handle device 903. Using the initial set-up information and the information detected during the hitter's swing, the batting system 900 automatically determines by use of the processor the optimum bat weight and/or the user's hitting form. The user may then record and store this simulated information in a device having a processor, such as a PDA or smartphone, for use when testing, selecting or practicing with any of the handle weighted devices described herein.

Figure 17:
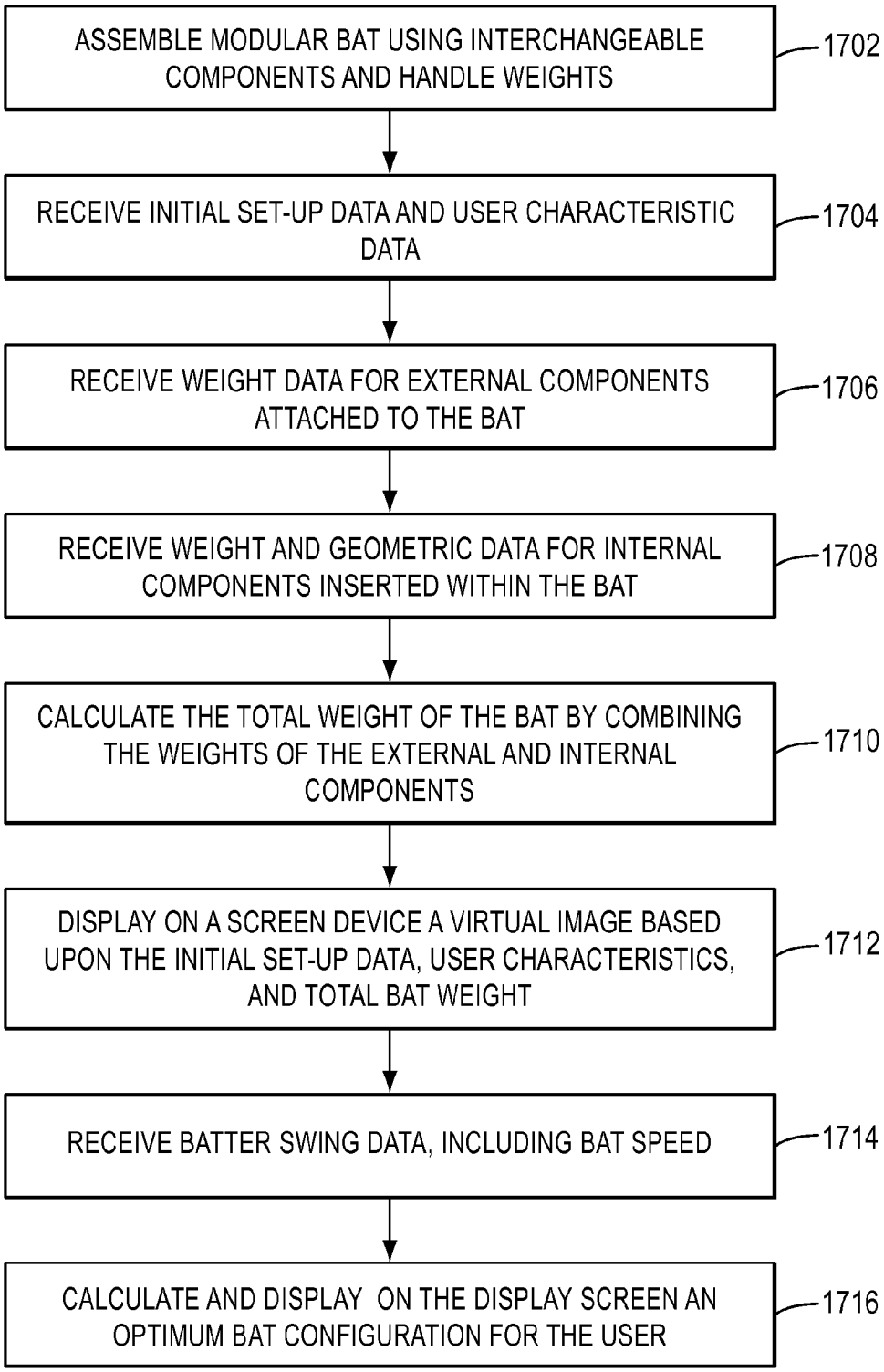
FIG. 17 illustrates a method of selecting a custom-fit modular handle weighted bat in accordance with the present teachings.

FIG. 17 illustrates a method of selecting a custom-fit modular handle weighted bat for a user. In step 1702, the user assembles the modular bat using interchangeable components and handle weights. Then, in step 1704, the user uses an input device to enter initial set-up and user characteristic data, which is transmitted and received by the network system. In step 1706, the network system receives weight data for external components attached to the bat. In step 1708, the network system receives weight and geometric data for internal components inserted within the bat. In step 1710, a computer device calculates the total weight of the bat by combining the weights of the external and internal components. In step 1712, a virtual image based upon the initial set-up data, user characteristics, and total bat weight is displayed on a display screen. In step 1714, during a hitter's swing, the network system detects various parameters and receives information regarding batter swing data, including bat speed. In step 1716, the computer device calculates the optimum bat configuration for the user, suggests the best composition of interchangeable components, and displays this information on the display screen.

Other embodiments of the disclosure will be apparent to those skilled in the art from consideration of the specification and practice of the teachings disclosed herein. It is intended that the specification and examples be considered as exemplary only. For example, the weighted handle device can be used to train and enhance performance in a variety of sports and activities. For example, softball products can include practice swing clubs of varying weights with knobs at one or both ends for use by Little League, scholastic, amateur, professional and recreational players, as well as practice bats of various weights, constructions, and designs as appropriate for the level of play. Golf products can include practice clubs of varying weights to assist with stretching exercises, and weighted grips can be incorporated into to the design of the competition and recreational golf club sets. Tennis, badminton, squash and racket ball products can include practice swing clubs of varying weights fitted with sport specific grip designs and training rackets for use in practice play. Hockey, lacrosse, field hockey products can include practice sticks of varying weights for use in training drills. Martial arts products can include hand held devices of varying weights for use in various martial arts systems that utilize weapons and other implements as part of forms training. General fitness products can include non-sports specific swing devices of varying weights and designs which can be used as a part of stretching, flexibility, therapy, strengthening or rehabilitation systems.

What is claimed is:

1. A bat comprising:

an elongated hollow barrel portion having an impact region and an open end and the barrel portion configured having a tubular section including an elongated chamber therein;

a handle weighted portion configured to provide a heavy handle construction such that the largest concentration of mass is provided in a handle portion and for positioning a center of gravity within the handle portion of the bat;

the handle weighted portion has a one-piece, solid body construction forged from a single piece of metal to form an integral knob and rod portion;

a knob configured having a shape that tapers outwardly toward the end of the knob, and the weight distribution within the knob is configured such that the weight gradually increases such that the heaviest portion is positioned at the end of the knob;

a rod portion integrally extending from the knob such that the rod portion is disposed within the open end of the barrel portion when assembled the knob has a step-down portion which defines a diameter of the rod having a reduced profile; and a non-threaded connector comprising a plurality of attachment mechanisms inserted into respective bores drilled in the barrel portion and the rod portion to rigidly connect the barrel portion to the rod portion wherein the plurality of attachment mechanisms is oriented at a 90 degree angle relative to each other.

2. The bat of claim 1, wherein the barrel portion comprises aluminum.

3. The bat of claim 1, wherein the barrel portion comprises wood.

4. The bat of claim 1, wherein the handle weighted portion is forged using impression die forging.

5. The bat of claim 1, wherein the handle weighted portion is forged using cold forging, open die forging, or seamless rolled ring forging.

6. The bat of claim 1, wherein the handle weighted portion is forged from a single piece of carbon steel.

7. The bat of claim 6, further comprising a chrome plated layer formed on an entire surface of the carbon steel.

8. The bat of claim 1, wherein the handle weighted portion is forged from a single piece of stainless steel.

9. The bat of claim 1, wherein the knob is configured having a generally bell shape.

10. The bat of claim 1, wherein the plurality of attachment mechanisms comprises a pair of spring pins inserted into the respective bores drilled in the barrel portion and the rod portion to rigidly connect the barrel portion to the rod portion and wherein the pair of spring pins is oriented at a 90 degree angle relative to each other.

* * * * *